US009713209B2

(12) United States Patent
Ackmann

(10) Patent No.: US 9,713,209 B2
(45) Date of Patent: Jul. 18, 2017

(54) LIGHT EMITTING DIODE DRIVER WITH HOUSING HAVING OPENING FOR RECEIVING A PLUG-IN MODULE AND METHOD OF OPERATING THEREOF

(71) Applicant: Crestron Electronics, Inc., Rockleigh, NJ (US)

(72) Inventor: Evan Ackmann, Hoboken, NJ (US)

(73) Assignee: Crestron Electronics, Inc., Rockleigh, NJ (US)

( * ) Notice: Subject to any disclaimer, the term of this patent is extended or adjusted under 35 U.S.C. 154(b) by 0 days.

(21) Appl. No.: 15/239,310

(22) Filed: Aug. 17, 2016

(65) Prior Publication Data

US 2016/0374168 A1 Dec. 22, 2016

Related U.S. Application Data

(63) Continuation-in-part of application No. 15/084,889, filed on Mar. 30, 2016, now Pat. No. 9,572,217, which is a continuation-in-part of application No. 14/565,382, filed on Dec. 9, 2014, now abandoned.

(60) Provisional application No. 61/913,486, filed on Dec. 9, 2013.

(51) Int. Cl.

| | |
|---|---|
| ***H05B 37/02*** | (2006.01) |
| ***H05B 33/08*** | (2006.01) |
| *F21V 23/00* | (2015.01) |
| *F21V 23/06* | (2006.01) |

(52) U.S. Cl.

CPC ..... *H05B 33/0815* (2013.01); *H05B 33/0848* (2013.01); *F21V 23/008* (2013.01); *F21V 23/06* (2013.01)

(58) Field of Classification Search

CPC ..... H05B 33/0848
USPC ..... 315/291, 308
See application file for complete search history.

(56) References Cited

U.S. PATENT DOCUMENTS

| | | | | |
|---|---|---|---|---|
| 4,829,521 | A | 5/1989 | Southard | |
| 7,322,718 | B2 * | 1/2008 | Setomoto | H05B 33/0803 315/309 |
| 7,375,476 | B2 | 5/2008 | Walter et al. | |
| 8,436,542 | B2 | 5/2013 | Middleton-White et al. | |
| 8,476,844 | B2 | 7/2013 | Hancock et al. | |
| 8,492,987 | B2 | 7/2013 | Nuhfer et al. | |
| 8,878,454 | B2 | 11/2014 | Rix et al. | |
| 8,979,299 | B2 | 3/2015 | Hsia et al. | |

(Continued)

*Primary Examiner* — Thuy Vinh Tran
(74) *Attorney, Agent, or Firm* — Crestron Electronics, Inc.

(57) ABSTRACT

Devices, systems, software, and methods for control of light emitting diodes (LEDs) via an LED driver circuit that receives an input signal from a power source and generates an output signal to power at least one LED element. The LED driver comprises a driver housing, an opening in the driver housing configured for receiving a removable plug-in module, and a plug-in interface configured for providing electrical connection between the plug-in module and the LED driver. The plug-in module comprises an external memory storing configuration information. The LED driver further comprises at least one driver circuit disposed within the driver housing and comprising an internal memory and a microcontroller. The microcontroller is configured for receiving the configuration information from the external memory of the plug-in module and regulating the output signal provided to the at least one LED element based on the configuration information.

40 Claims, 13 Drawing Sheets

(56) References Cited

U.S. PATENT DOCUMENTS

| | | | | |
|---|---|---|---|---|
| 2006/0262544 | A1* | 11/2006 | Piepgras | F21K 9/00 362/373 |
| 2008/0136334 | A1* | 6/2008 | Robinson | H05B 37/0254 315/151 |
| 2011/0134634 | A1 | 6/2011 | Gingrich, III | |

* cited by examiner

LIGHT EMITTING DIODE DRIVER WITH HOUSING HAVING OPENING FOR RECEIVING A PLUG-IN MODULE AND METHOD OF OPERATING THEREOF

BACKGROUND OF THE INVENTION

Technical Field

The present invention relates generally to lighting control. More particularly, the invention relates to devices, systems, software, and methods for control of light emitting diodes (LEDs).

Background Art

Increasingly, light emitting diodes (LEDs) are providing lighting to commercial and residential structures. These LED lamps and fixtures provide many benefits over conventional lighting technologies, such as higher efficiency, increased lifetime, and relatively safer materials.

An LED driver is an electrical device that regulates power to the LED. LED drivers receive line voltages and convert them to the low voltages typically required by LEDs. There are many types of LED drivers. LED drivers may be internal or external to the LED lamp or fixture and may supply either a constant voltage or a constant current to the lamp or fixture. Certain drivers allow dimming of LEDs, thereby providing a range of lighting levels as well as energy saving opportunities and increased lifetime of the LED.

Traditional phase controlled two-wire LED drivers receive a phase controlled dimmed signal from a dimmer and dim the LED lamps using a dimming scheme based on inhibiting the LED power supply. The lower incoming root mean square (RMS) power is used as raw power delivery that is directly translated to the outbound power delivered into the LED element. In other implementations, a pulse width modulation (PWM) circuitry is included at the front end of the LED driver that applies pulse width modulation directly to the incoming phase controlled dimmed signal and feeds that to the LED element. These implementations, while inexpensive, create several problems.

The power delivered into the LED element is inconsistent causing inconsistent light output and dimming levels. At very low dimming levels, this inconsistency will cause the power supply of the LED driver to sometimes turn on, and at other times turn off. If the power supply is turned off, there will be a period of time where the light will be visibly out. This may cause the LEDs to experience undesired behaviors, such as perceivable flickering or even "dropout" periods. The LEDs may also "pop on" because of this power supply design. Additionally, the LEDs may be at their max brightness well before full power is delivered to them.

Further, dimming LEDs in this manner causes a non-linear relationship between intended brightness and actual LED lumen output. Particularly, in practice the incoming phase controlled dimmed signal is not a perfect sine wave. The wave line suffers from noise that may cause significant fluctuation in voltage levels. At very low dimming levels, and thereby low voltage levels, the noise may cause the LED to turn on at a much lower voltage level than intended. This scheme also produces instability back towards zero cross circuitry. The noise may cause the wave to cross zero voltage at multiple points. In determining the zero cross, the wrong zero cross point may be used, causing a shift in the time cycle. Even a small shift may cause instability in dimming levels, resulting in unwanted flickering.

Accordingly, there is now a need for improved drivers of LED lamps.

There is also an issue of LED driver configuration and failures in the field. While LEDs are praised for their vast lifespan, the lifetime of an LED bulb is no longer a function of the LED element. The point of failure of an LED fixture is an electrical device that regulates the power to the LED element, called the LED driver. An LED driver converts incoming power, generally of a high voltage alternating current, to a low voltage direct current at ratings required by the LED. Drivers may fail prematurely due to high internal operating temperatures. Systems where LED drivers store a lot of information, such as custom programming and network addresses, a failure of an LED driver causes this information to get lost.

Replacement or reprogramming of constant current LED drivers is troublesome due to configuration requirements. LEDs are rated to operate within a certain current range. Too much or too little current can cause light output to vary or the LED to degrade faster due to high temperatures. Constant current LED drivers therefore need to be tailored specifically to the LED element to which they are attached. Today, this configuration is typically done one of three ways. LED drivers may be factory configured and ordered with a specified current rating. When such a driver fails, a field technician needs to special order an LED driver that matches the current rating of the LED element. This entails wasted time; becomes costly as excess stock of LED drivers has to be maintained, taking up valuable warehouse space; and is error prone as an incorrectly ordered and installed driver may cause the LED element to suffer overdrive and failure. LED drivers may also be software programmable at the fixture manufacturer to match to the requirements of the LED element. When the LED driver fails, this programming information is lost and a technician needs to reprogram a new LED driver. Lastly, a resistor may be placed on a set of jumpers to configure the current levels. These aforementioned solutions, however, are costly and impractical in the field.

Additionally, network-based LED drivers (and ballasts), such as ones using the Digital Addressable Lighting Interface (DALI) data transmission protocol, are soft-addressed at the time of commissioning. Consequently, any replacement of the LED driver necessitates a commissioning agent to readdress the new device with the address and parameters of the original LED driver. This is inconvenient and costly to users.

Therefore, there is now a need for improved configuration and replacement of LED drivers.

SUMMARY OF THE INVENTION

It is an object of the embodiments to substantially solve at least the problems and/or disadvantages discussed above, and to provide at least one or more of the advantages described below.

It is therefore a general aspect of the embodiments to provide systems, methods, and modes for an LED driver that will obviate or minimize problems of the type previously described, including but not limited to inadequate dimming and impractical configuration of LED drivers.

It is an aspect of the embodiments to provide devices, systems, software, and methods for control of light emitting diodes (LEDs).

It is also an aspect of the embodiments to provide a driver circuit for an LED driver for application with a dimmer in a two-wire configuration that uses the dimmed signal as power for the LED and information dictating dimming levels of the LED.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

Further features and advantages of the aspects of the embodiments, as well as the structure and operation of the various embodiments, are described in detail below with reference to the accompanying drawings. It is noted that the aspects of the embodiments are not limited to the specific embodiments described herein. Such embodiments are presented herein for illustrative purposes only. Additional embodiments will be apparent to persons skilled in the relevant art(s) based on the teachings contained herein.

DISCLOSURE OF INVENTION

According to an embodiment, a light emitting diode (LED) driver is provided for receiving an input signal and generating an output signal to power at least one LED element. The LED driver may comprise a driver housing and an opening in the driver housing configured for receiving a removable plug-in module. The plug-in module may comprise an external memory storing configuration information and an identification number of the plug-in module. The configuration information may comprise current output level. The LED driver may further comprise a plug-in interface configured for providing electrical connection between the plug-in module and the LED driver. Further, the LED driver comprises at least one driver circuit disposed within the driver housing and comprising an internal memory, a microcontroller, and a plug-in detection circuit. The microcontroller comprises a processor configured for executing one or more processor-executable instructions stored in the internal memory that cause acts to be performed comprising: (i) receiving a signal that the plug-in module is plugged into the plug-in interface from the plug-in detection circuit; (ii) reading the identification number of the plug-in module; (iii) associating the identification number of the plug-in module with the LED driver and storing the association on the internal memory; (iv) receiving the configuration information from the external memory of the plug-in module; and (v) regulating the output signal provided to the at least one LED element such that the driver circuit generates an output signal substantially equal to the output current level.

According to another embodiment, a light emitting diode (LED) driver is provided for receiving an input signal and generating an output signal to power at least one LED element. The LED driver may comprise a driver housing and an opening in the driver housing configured for receiving a removable plug-in module. The plug-in module may comprise an external memory storing configuration information. The LED driver may further comprise a plug-in interface configured for providing electrical connection between the plug-in module and the LED driver. The LED driver may also comprise at least one driver circuit disposed within the driver housing and comprising an internal memory and a microcontroller. The microcontroller may comprise a processor configured for executing one or more processor-executable instructions that cause acts to be performed comprising: receiving the configuration information from the external memory of the plug-in module; and regulating the output signal provided to the at least one LED element based on the configuration information.

According to further aspects of the embodiments, the plug-in module may comprise a housing portion and a printed circuit board (PCB) containing the external memory. The opening in the housing portion may comprise a first recessed portion sized and shaped for receiving the housing portion of the plug-in module, and a second recessed portion sized and shaped for receiving the PCB. According to an embodiment, the driver housing is configured for receiving the plug-in module such that the PCB is internal to the driver housing and an upper surface of the housing portion of the plug-in module is substantially flush with an outer surface of the driver housing. According to an embodiment, the plug-in interface may comprise at least one of a serial port, a Universal Serial Bus (USB) interface, a mini-USB interface, a micro-USB interface, a CREScode interface, a RJ45 interface, or the like.

According to another embodiment, the microcontroller may be further configured for: writing the configuration information from the external memory of the plug-in module to the internal memory; and regulating the output signal provided to the at least one LED element based on the configuration information stored on the internal memory.

According to another embodiment, the configuration information may comprise an output current level, wherein the microcontroller regulates the output signal such that the driver circuit generates an output signal substantially equal to the output current level. The LED driver may comprise a plurality of outputs, and wherein the configuration information comprises output current levels for each output of the plurality of outputs. According to yet another embodiment, the input signal may comprise a dimming level, wherein the microcontroller is further configured for: detecting an incoming dimming level of the input signal; and generating an output duty cycle $D_{out}$ based upon the detected incoming dimming level and the configuration information; wherein the driver circuit is configured for generating a current to drive the at least one LED element based on the output duty cycle $D_{out}$.

According to yet another embodiment, the configuration information comprises one or more dimming level parameters. The one or more dimming level parameters may comprise at least one of a maximum dimming level, a minimum dimming level, or a combination thereof. The one or more dimming level parameters may also comprise parameters configured for keeping the LED element at a low power until the detected incoming duty cycle $D_{in}$ exceeds a low-end dimming level. The one or more dimming level parameters may comprise parameters configured for setting the output duty cycle $D_{out}$ equal to a minimum duty cycle output value $D_{min}$ when the detected incoming duty cycle $D_{in}$ falls below a low-level duty cycle threshold $D_{Lth}$. In another embodiment, the one or more dimming level parameters comprise parameters configured for keeping the LED element at a high power when the detected incoming dimming level exceeds a high-end dimming level. The one or more dimming level parameters may further comprise parameters configured for setting the output duty cycle $D_{out}$ equal to a maximum duty cycle output value $D_{max}$ when the detected incoming duty cycle $D_{in}$ exceeds a high-level duty cycle threshold $D_{Hth}$. The one or more dimming level parameters may also comprise parameters configured for scaling the detected incoming duty cycle $D_{in}$ to a value between a low end rescale value $S_L$ and a high end rescale value $S_H$ when the detected incoming duty cycle $D_{in}$ falls between a low-level duty cycle threshold $D_{Lth}$ and a high-level duty cycle threshold $D_{Hth}$. According to yet another embodiment, the configuration information may indicate a type of a dimming curve, including at least one of a linear curve a logarithmic curve, a modified linear curve, a square law curve, a modified square law curve, a sensor 2.0 curve, or the like.

According to a further embodiment, the configuration information may comprise a negative temperature coefficient (NTC) throttling temperature value. The configuration information may also comprise network configuration information for the LED driver. The network configuration information may also comprise at least one of a network address, a group assignment, a lighting scene value, a dimming level, a fading time, a hold time, and any combinations thereof.

According to an embodiment, the external memory of the plug-in module may comprise an identification number of the plug-in module. The microcontroller may be further configured for: reading the identification number of the plug-in module; and determining whether the identification number matches an identification number stored on the internal memory. According to another embodiment, the microcontroller may be further configured for: when the identification number of the plug-in module does not match the identification number stored on the internal memory or when no identification number is stored on the internal memory, determining whether the external memory of the plug-in module comprises configuration information; when the external memory comprises configuration information, writing configuration information from the external memory of the plug-in module to the internal memory; and when the external memory does not comprise configuration information, writing configuration information from the internal memory to the external memory. The microcontroller may determine whether the plug-in module comprises configuration information by determining whether the plug-in module comprises a write count. According to another embodiment, the microcontroller may be further configured for: when the identification number of the plug-in module matches the identification number stored on the internal memory, comparing a write count of the external memory to the write count of the internal memory; when the write count of the external memory is larger than the write count of the internal memory, writing configuration information from the external memory of the plug-in module to the internal memory; and when the write count of the internal memory is larger than the write count of the external memory, writing configuration information from the internal memory to the external memory.

In another embodiment, the microcontroller may be further configured for: reading the identification number of the plug-in module; and storing the identification number of the plug-in module on the internal memory in a plug-in module identification number history log. In another embodiment, the microcontroller may be further configured for: associating the identification number of the plug-in module with the LED driver and storing the association on the internal memory. In another embodiment, the LED driver may receive a second removable plug-in module comprising a second external memory storing a second configuration information and a second identification number, wherein the microcontroller is further configured for: determining whether the second identification number matches the identification number stored on the internal memory; writing the second configuration information from the second external memory of the second plug-in module to the internal memory; and regulating the output signal provided to the at least one LED element based on the second configuration information. According to another embodiment, the microcontroller may be further configured for: determining whether a new plug-in module has been received by the LED driver by determining whether an identification number of a newly inserted plug-in module matches an identification number stored on the internal memory.

According to an embodiment, the at least one driver circuit may comprise a plug-in detection circuit configured for detecting whether a plug-in module is plugged into the plug-in interface. The internal memory of the LED driver may comprise an identification number of the LED driver. The microcontroller may be further configured for: storing the identification number of the LED driver on the external memory in an LED driver identification number history log.

According to another aspect of the embodiment, a method is provided for providing a light emitting diode (LED) driver comprising a driver housing, an opening in the driver housing, a plug-in interface in the opening, at least one driver circuit disposed within the driver housing and comprising an internal memory and a microcontroller. The method may comprise the steps of: receiving a plug-in module through the opening and in the plug-in interface, wherein the plug-in module comprises an external memory storing configuration information; receiving the configuration information from the external memory of the plug-in module; receiving an input signal from a power source; and generating an output signal to power at least one LED element based on the configuration information.

The input signal may comprise a dimming level, and the method may further comprise the steps of: detecting an incoming duty cycle of the input signal; and generating an output duty cycle based upon the detected incoming duty cycle and the configuration information; wherein the output signal is generated based on the output duty cycle. According to another embodiment, the method may further comprise the steps of: writing the configuration information from the external memory of the plug-in module to the internal memory of the LED driver. The external memory of the plug-in module may comprise an identification number of the plug-in module, and the method may further comprise the steps of: reading the identification number of the plug-in module; and determining whether the identification number of the plug-in module matches an identification number stored on the internal memory.

According to another embodiment, the method may further comprise the steps of: when the identification number of the plug-in module does not match the identification number stored on the internal memory or when no identification number is stored on the internal memory, determining whether the external memory of the plug-in module has a write count; when the external memory comprises a write count, writing configuration information from the external memory of the plug-in module to the internal memory; and when the external memory does not comprise a write count, writing configuration information from the internal memory to the external memory. According to yet another embodiment, the method may further comprise the steps of: when the identification number of the plug-in module matches the identification number stored on the internal memory, comparing a write count of the external memory to the write count of the internal memory; when the write count of the external memory is larger than the write count of the internal memory, writing configuration information from the external memory of the plug-in module to the internal memory; and when the write count of the internal memory is larger than the write count of the external memory, writing configuration information from the internal memory to the external memory. In yet another embodiment, the external memory of the plug-in module may comprise an identification number of the plug-in module, and the method may further comprise the steps of: reading the identification number of the plug-in module; and associating the identification number of the plug-in module with the LED driver and storing the association on the internal memory of the LED driver.

According to another aspect of the embodiments, an LED driver circuit is provided that receives a dimmed AC input signal from a dimmer and generates an output signal to power and dim an LED element. The dimmed AC input signal may be a forward phase signal or a reverse phase signal. The LED driver circuit may comprise a dimmed input sense circuit, a microcontroller, and a power supply circuit. The power supply circuit may be configured for generating a power supply from the dimmed AC input signal for powering the LED driver circuit. The dimmed input sense circuit may be configured for detecting an incoming duty cycle $D_{in}$ of the dimmed AC input signal. The microcontroller may comprise a memory storing one or more dimming level parameters, and a processor configured for executing one or more processor-executable instructions stored in the memory. The microcontroller may receive the detected incoming duty cycle $D_{in}$ from the dimmed input sense circuit, and generate an output duty cycle $D_{out}$ based on the detected incoming duty cycle $D_{in}$ and the one or more dimming level parameters. The LED driver circuit may generate the output signal using the generated output duty cycle $D_{out}$ for powering the LED element at a generated dimming level.

The LED driver circuit may further comprise a rectifier configured for converting the dimmed AC input signal into a rectified DC voltage bus signal, wherein the dimmed input sense circuit detects the incoming duty cycle $D_{in}$ of the dimmed AC input signal from the rectified DC voltage bus signal. The power supply circuit may comprise an active load configured for presenting a substantially constant load to the dimmer to keep the dimmer above a shut off current level. The power supply circuit may comprise a power factor corrector (PFC) configured for correcting a power factor of the dimmed AC input signal. The power supply circuit may comprise a high voltage bus configured for providing power storage and outputting a high-voltage smoothed DC voltage output signal. The power supply circuit may also comprise a high voltage power supply including a transformer configured for transforming the high-voltage smoothed DC voltage output signal into a smoothed DC output signal with a voltage level suitable for powering the LED element. The power supply circuit may further comprise a low voltage supply comprising a transformer configured for transforming the smoothed DC output signal to a low-voltage DC signal with a voltage level suitable for powering the microcontroller. The power supply circuit may comprise a capacitor and a diode.

Additionally, the power supply circuit may comprise a high voltage power supply configured for isolating a high-voltage side of the LED driver circuit from the low-voltage side of the LED driver circuit. The dimmed input sense circuit may be located in front of the power supply circuit. The LED driver circuit may comprise an isolated high-voltage side and a low-voltage side, wherein the high-voltage side comprises the dimmed input sense circuit and the low-voltage side comprises the microcontroller.

The dimmed input sense circuit may detect the incoming duty cycle $D_{in}$ directly or infer the incoming duty cycle $D_{in}$ from one or more variables of a waveform of the dimmed AC input signal. The one or more variables of the waveform may comprise a switch-on time after zero cross, a voltage of switch-on time after zero cross, a switch-off time after zero-cross, a voltage of a switch-off time after zero cross, or the like, or any combinations thereof. The dimmed input sense circuit may comprise a resistor divider into a transistor configured for determining the ON time that the dimmer is presenting to the LED driver circuit. The dimmed input sense circuit may output a low-voltage DC square wave signal comprising the detected incoming duty cycle $D_{in}$. Furthermore, the dimmed input sense circuit may comprise an optical isolator configured for transmitting the low-voltage DC square wave signal from a high-voltage side of the LED circuit to the microcontroller on a low-voltage side of the LED driver circuit. The optical isolator may comprise an optical diode. The microcontroller may comprise a duty cycle detector configured for translating the low-voltage DC square wave signal to a value indicating the detected incoming duty cycle $D_{in}$.

The one or more dimming level parameters may comprise parameters configured for keeping the LED element at a low power until the detected incoming duty cycle $D_{in}$ exceeds a low-end dimming level. The one or more dimming level parameters may comprise parameters configured for setting the output duty cycle $D_{out}$ equal to a minimum duty cycle output value $D_{min}$ when the detected incoming duty cycle $D_{in}$ falls below a low-level duty cycle threshold $D_{Lth}$. The minimum duty cycle output value $D_{min}$ may be smaller than the low-level duty cycle threshold $D_{Lth}$. The low-level duty cycle threshold $D_{Lth}$ may comprise a value within a range from above 0% to about 30%. The minimum duty cycle output value $D_{min}$ may comprise a value within a range from above 0% to about 20%.

Additionally, the one or more dimming level parameters may comprise parameters configured for keeping the LED element at a high power when the detected incoming duty cycle $D_{in}$ exceeds a high-end dimming level. The one or more dimming level parameters may comprise parameters configured for setting the output duty cycle $D_{out}$ equal to a maximum duty cycle output value $D_{max}$ when the detected incoming duty cycle $D_{in}$ exceeds a high-level duty cycle threshold $D_{Hth}$. The maximum duty cycle output value $D_{max}$ may be larger than the high-level duty cycle threshold $D_{Hth}$. The high-level duty cycle threshold $D_{Hth}$ may comprise a value within a range from about 70% to below 100%. The maximum duty cycle output value $D_{max}$ may comprise a value within a range from about 80% to below 100%.

Furthermore, the one or more dimming level parameters may comprise parameters configured for scaling the detected incoming duty cycle $D_{in}$ to a value between a low end rescale value $S_L$ and a high end rescale value $S_H$ when the detected incoming duty cycle $D_{in}$ falls between a low-level duty cycle threshold $D_{Lth}$ and a high-level duty cycle threshold $D_{Hth}$. The parameters may be configured for evenly scaling the detected incoming duty cycle $D_{in}$ using the following formula:

$$D_{out} = \frac{(D_{Hth} - D_{Lth})(D_{in} - S_L)}{(S_H - S_L)} + D_{Lth}$$

where, $D_{in}$ is the detected incoming duty cycle, $D_{out}$ is the generated output duty cycle, $D_{Lth}$ is the low-level duty cycle threshold value, $D_{Hth}$ is the high-level duty cycle threshold value, $S_L$ is the low end rescale value, and $S_H$ is the high end rescale value.

The low end rescale value $S_L$ may be equal to about the minimum duty cycle output value $D_{min}$ and the high end rescale value $S_H$ may be equal to about the maximum duty cycle output value $D_{max}$. In another embodiment, the parameters configured for scaling the detected incoming duty cycle $D_{in}$ may comprise a look up table.

According to an embodiment, the one or more dimming level parameters may comprise parameters configured for (i) setting the output duty cycle $D_{out}$ equal to a minimum duty cycle output value $D_{min}$ when the detected incoming duty cycle $D_{in}$ falls below a low-level duty cycle threshold $D_{Lth}$, (ii) setting the output duty cycle $D_{out}$ equal to a maximum duty cycle output value $D_{max}$ when the detected incoming duty cycle $D_{in}$ exceeds a high-level duty cycle threshold $D_{Hth}$, and (iii) scaling the detected incoming duty cycle $D_{in}$ to a value between the minimum duty cycle output value $D_{min}$ and the maximum duty cycle output value $D_{max}$ when the detected incoming duty cycle $D_{in}$ falls between the low-level duty cycle threshold $D_{Lth}$ and the high-level duty cycle threshold $D_{Hth}$.

The LED driver circuit may generate the output signal for powering the LED element at a frequency above a frequency perceivable to a human eye or above a frequency capable of being detected by an optical device. The LED driver circuit may comprise an LED dimming circuit that generates a pulse width modulated signal based on the output duty cycle $D_{out}$ generated by the microcontroller.

According to another aspect of the embodiments, a method executed by an LED driver circuit is provided for powering and dimming an LED element. The method comprising: (i) storing one or more dimming level parameters; (ii) receiving a dimmed AC input signal from a dimmer; (iii) detecting an incoming duty cycle $D_{in}$ of the dimmed AC input signal; (iv) generating an output duty cycle $D_{out}$ based on the detected incoming duty cycle $D_{in}$ and the one or more dimming level parameters; (v) generating a power supply from the dimmed AC input signal for powering the LED driver circuit; and (vi) generating an output signal using the generated output duty cycle $D_{out}$ for powering the LED element at a generated dimming level.

According to yet another aspect of the embodiments, a method executed by an LED driver circuit is provided for powering and dimming an LED element. The method comprising: (i) receiving a dimmed AC input signal from a dimmer; (ii) detecting an incoming duty cycle $D_{in}$ of the dimmed AC input signal; (iii) generating an output duty cycle; (iv) generating a power supply from the dimmed AC input signal for powering the LED driver circuit; and (v) generating an output signal using the generated output duty cycle $D_{out}$ for powering the LED element at a generated dimming level. Wherein the output duty cycle is generated by: (a) setting the output duty cycle $D_{out}$ equal to a minimum duty cycle output value $D_{min}$ when the detected incoming duty cycle $D_{in}$ falls below a low-level duty cycle threshold $D_{Lth}$, (b) setting the output duty cycle $D_{out}$ equal to a maximum duty cycle output value $D_{max}$ when the detected incoming duty cycle $D_{in}$ exceeds a high-level duty cycle threshold $D_{Hth}$, and (c) scaling the detected incoming duty cycle $D_{in}$ to a value between the minimum duty cycle output value $D_{min}$ and the maximum duty cycle output value $D_{max}$ when the detected incoming duty cycle $D_{in}$ falls between the low-level duty cycle threshold $D_{Lth}$ and the high-level duty cycle threshold $D_{Hth}$.

Principles of the invention also provide a light emitting diode (LED) driver. According to a first aspect, a method for replacing LED drivers comprises the steps of: removing a first removably pluggable printed circuit board (PCB) from a first LED driver, the first removably pluggable printed circuit board comprising configuration information for the LED driver; determining if the first PCB is faulty; inserting the first PCB in a second LED driver if the first PCB is not faulty.

BRIEF DESCRIPTION OF DRAWINGS

The above and other objects and features of the embodiments will become apparent and more readily appreciated from the following description of the embodiments with reference to the following figures. Different aspects of the embodiments are illustrated in reference figures of the drawings. It is intended that the embodiments and figures disclosed herein are to be considered to be illustrative rather than limiting. The components in the drawings are not necessarily drawn to scale, emphasis instead being placed upon clearly illustrating the principles of the aspects of the embodiments. In the drawings, like reference numerals designate corresponding parts throughout the several views.

BRIEF DESCRIPTION OF THE SEVERAL VIEWS OF THE DRAWING

Figure 1:
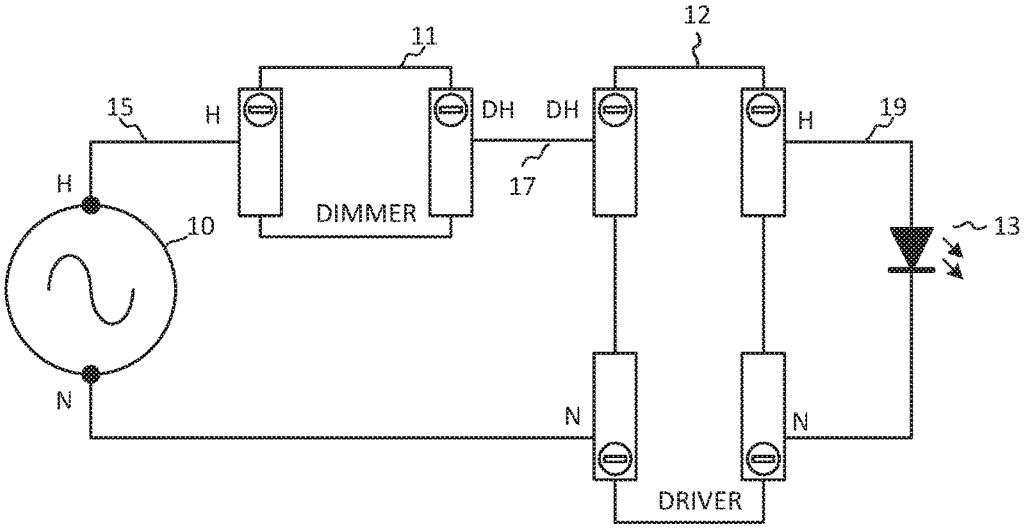

FIG. 1 shows an LED driver for use in a two-wire application, in accordance with an illustrative embodiment.

Figure 2:
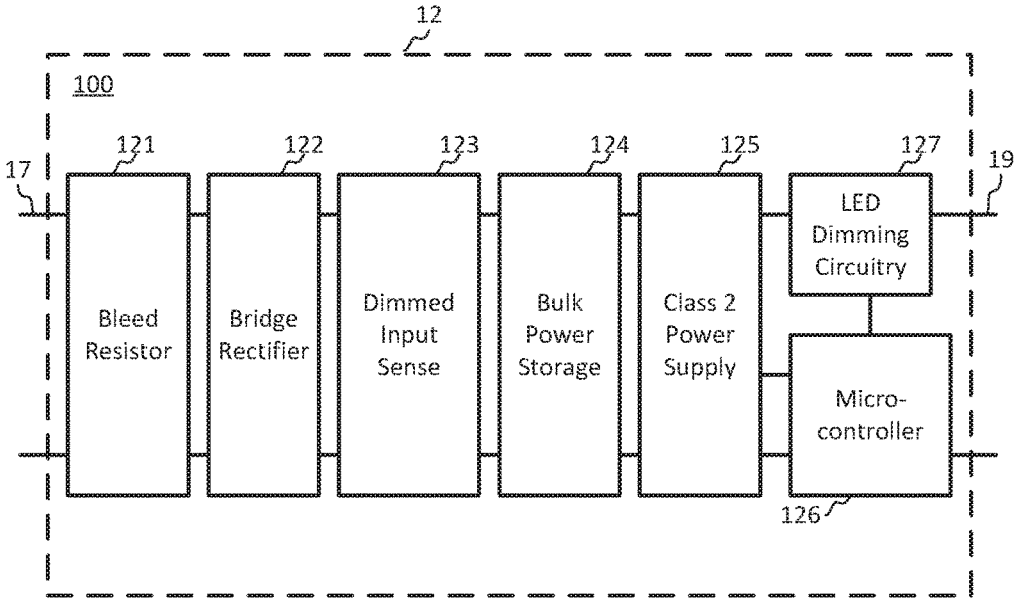

FIG. 2 is a block diagram of an LED driver circuit, in accordance with an illustrative embodiment.

Figure 3:
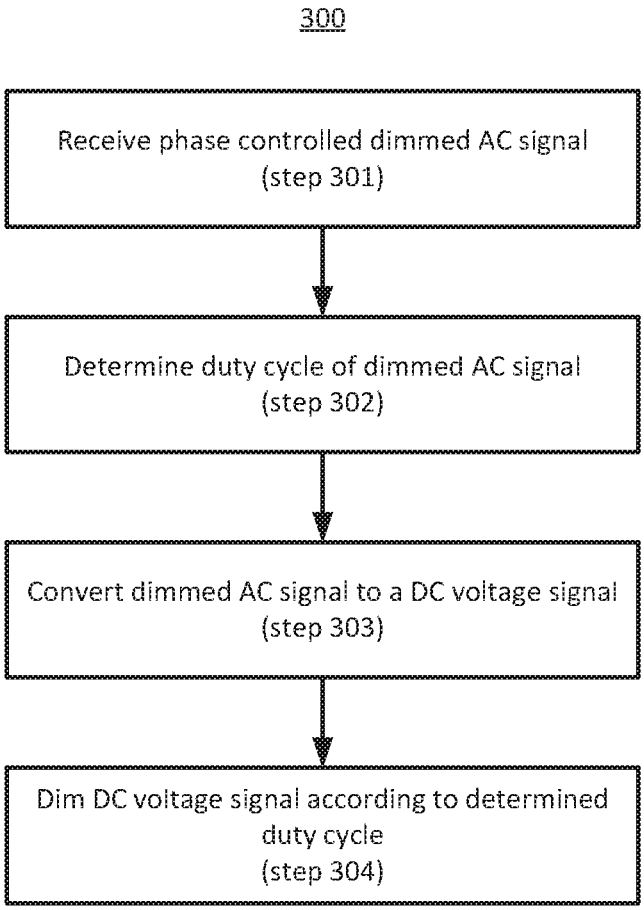

FIG. 3 is a flowchart illustrating steps for a method of driving an LED driver, in accordance with an illustrative embodiment.

Figure 4:
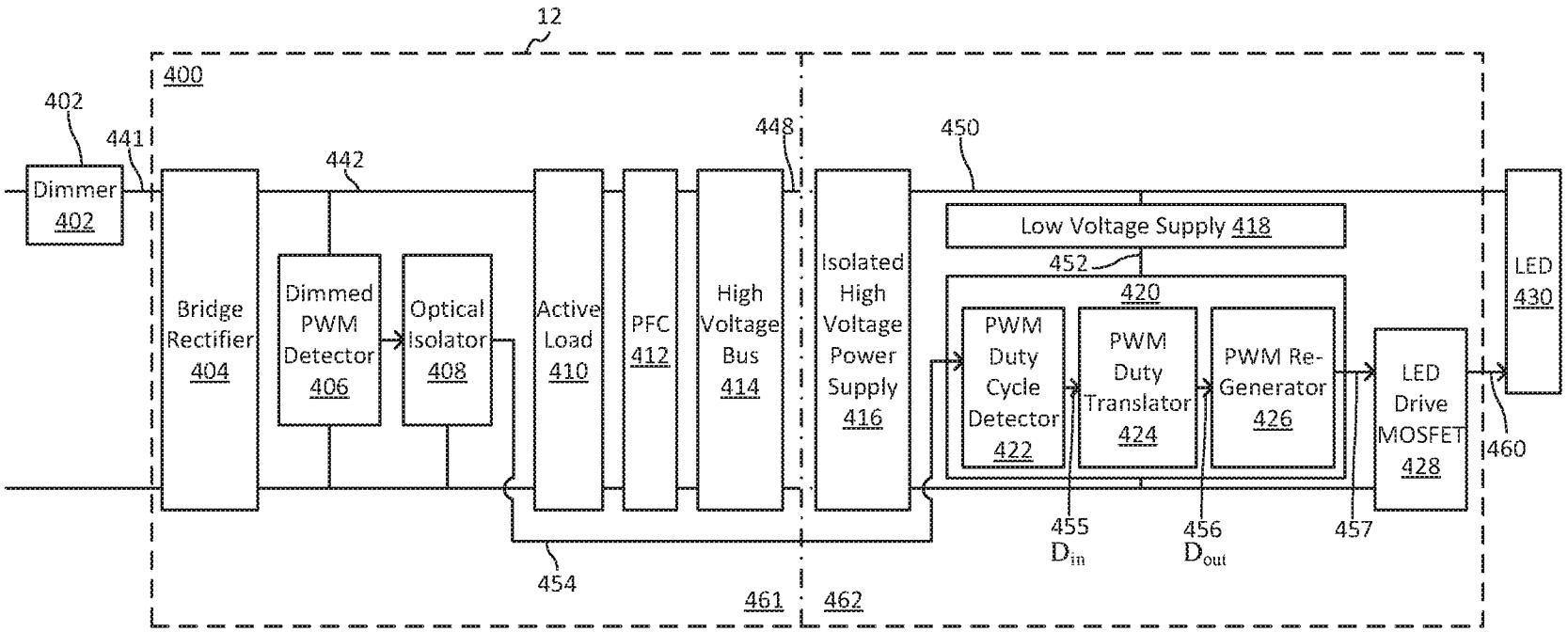

FIG. 4 is a detailed block diagram of an LED driver circuit of an LED driver for dimming an LED element, in accordance with an illustrative embodiment.

FIGS. 5A-5F are wave diagrams illustrating a received input signal of 50% dimming level and resulting output signals generated by the LED driver, in accordance with an illustrative embodiment.

Figure 6A:
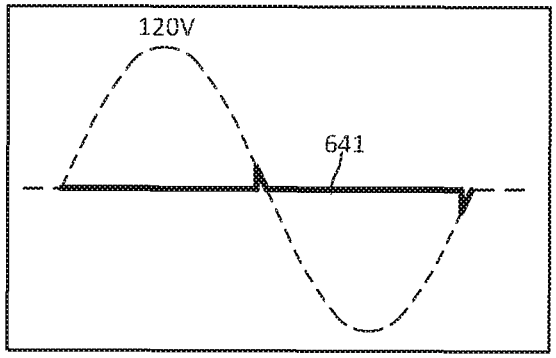
Figure 6B:
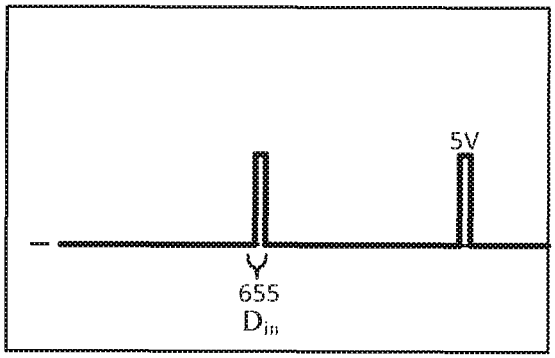
Figure 6C:
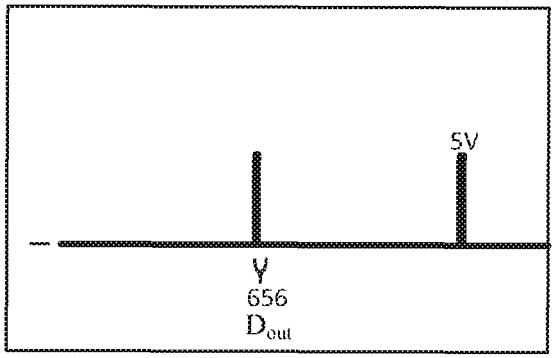

FIGS. 6A-6C are wave diagrams illustrating a received input signal at a low-end dimming level and resulting output signals generated by the LED driver, in accordance with an illustrative embodiment.

Figure 7:
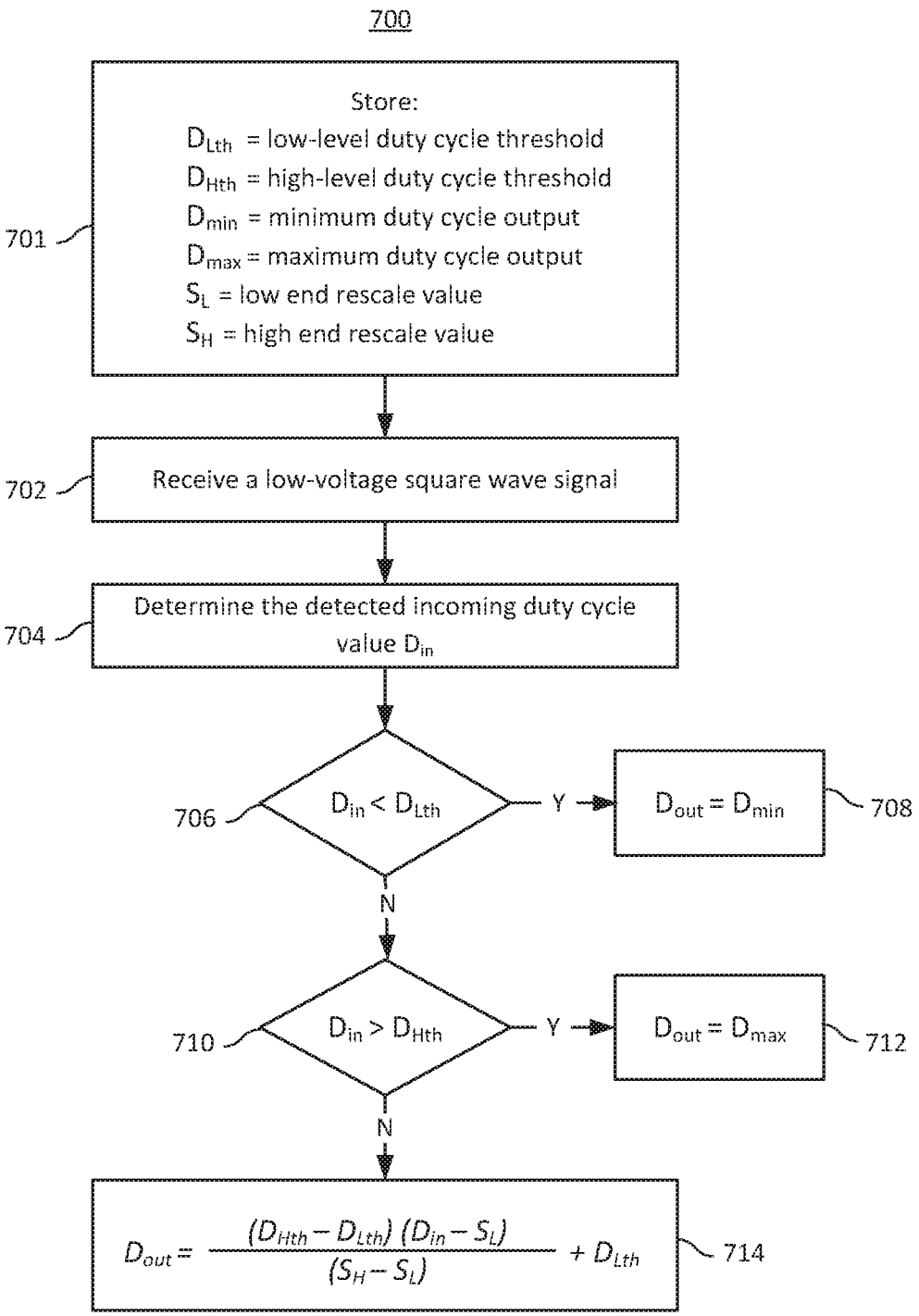

FIG. 7 is a flowchart illustrating the steps for a method of generating an output duty cycle $D_{out}$ based on a detected incoming duty cycle $D_{in}$.

Figure 8:
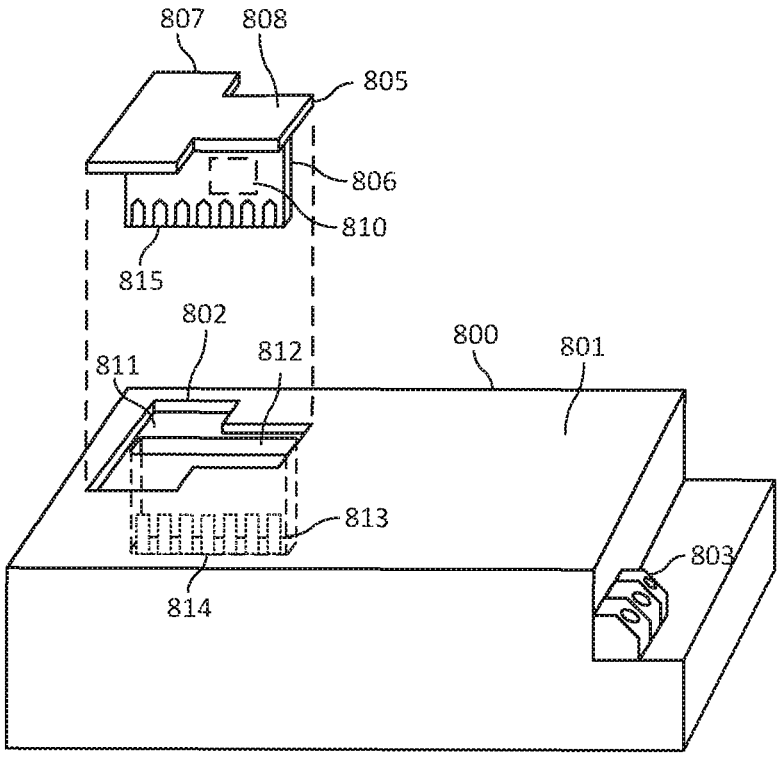

FIG. 8 illustrates an LED driver, in accordance with an illustrative embodiment of the invention.

Figure 9:
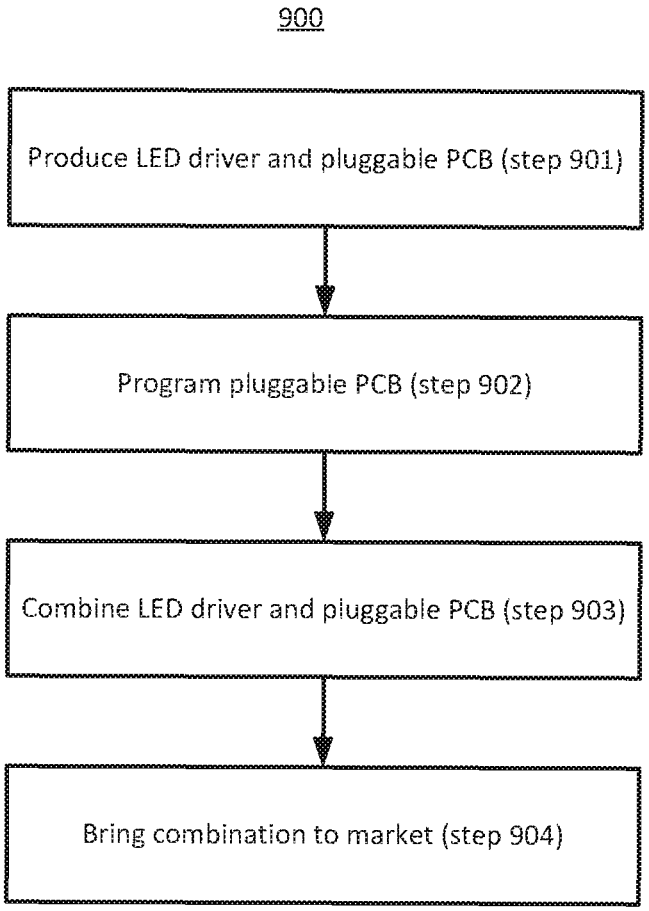

FIG. 9 is a flowchart illustrating steps for a method of providing an LED driver, in accordance with an illustrative embodiment of the invention.

Figure 10:
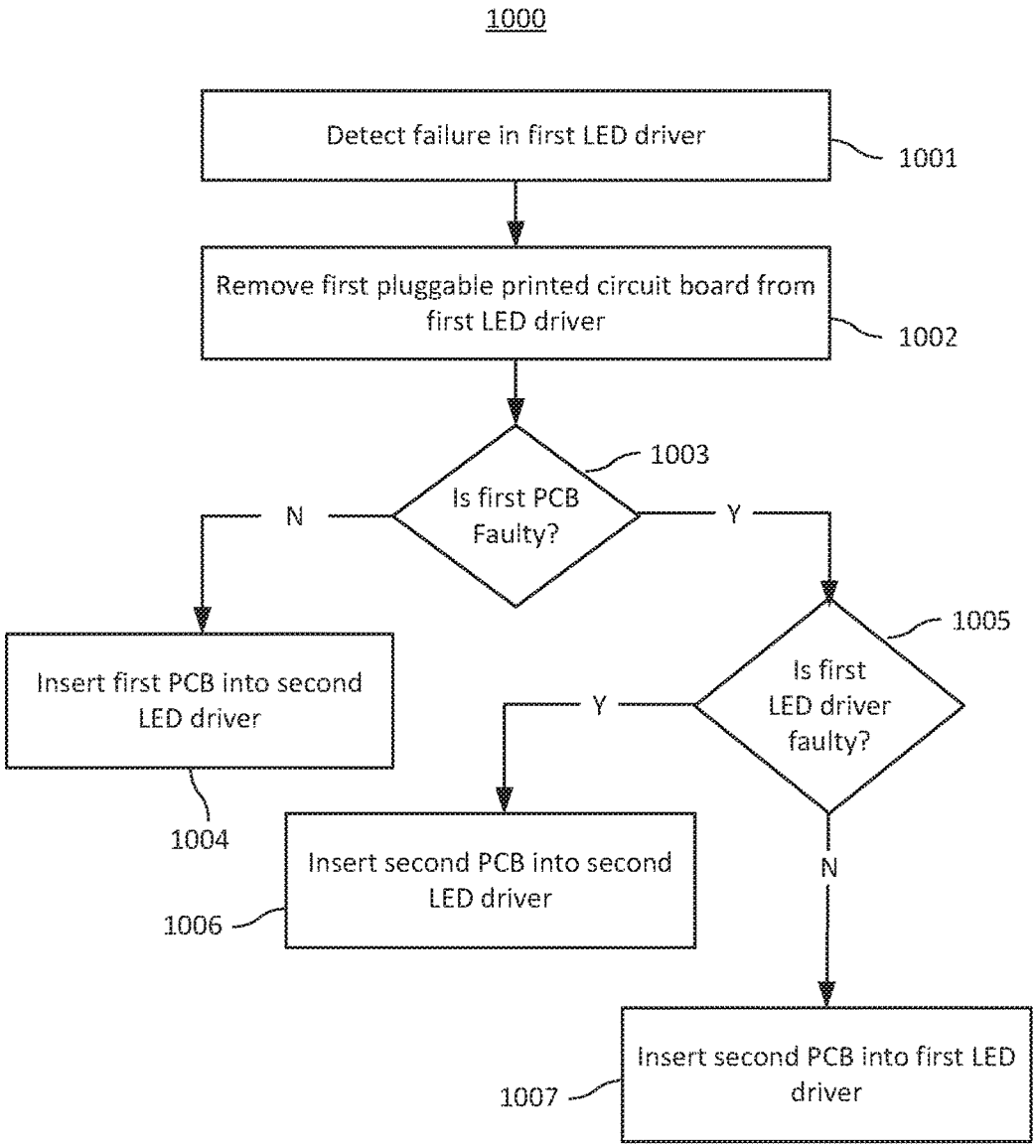

FIG. 10 is a flowchart illustrating steps for a method of replacing a pluggable configuration module of an LED driver, in accordance with an illustrative embodiment of the invention.

Figure 11:
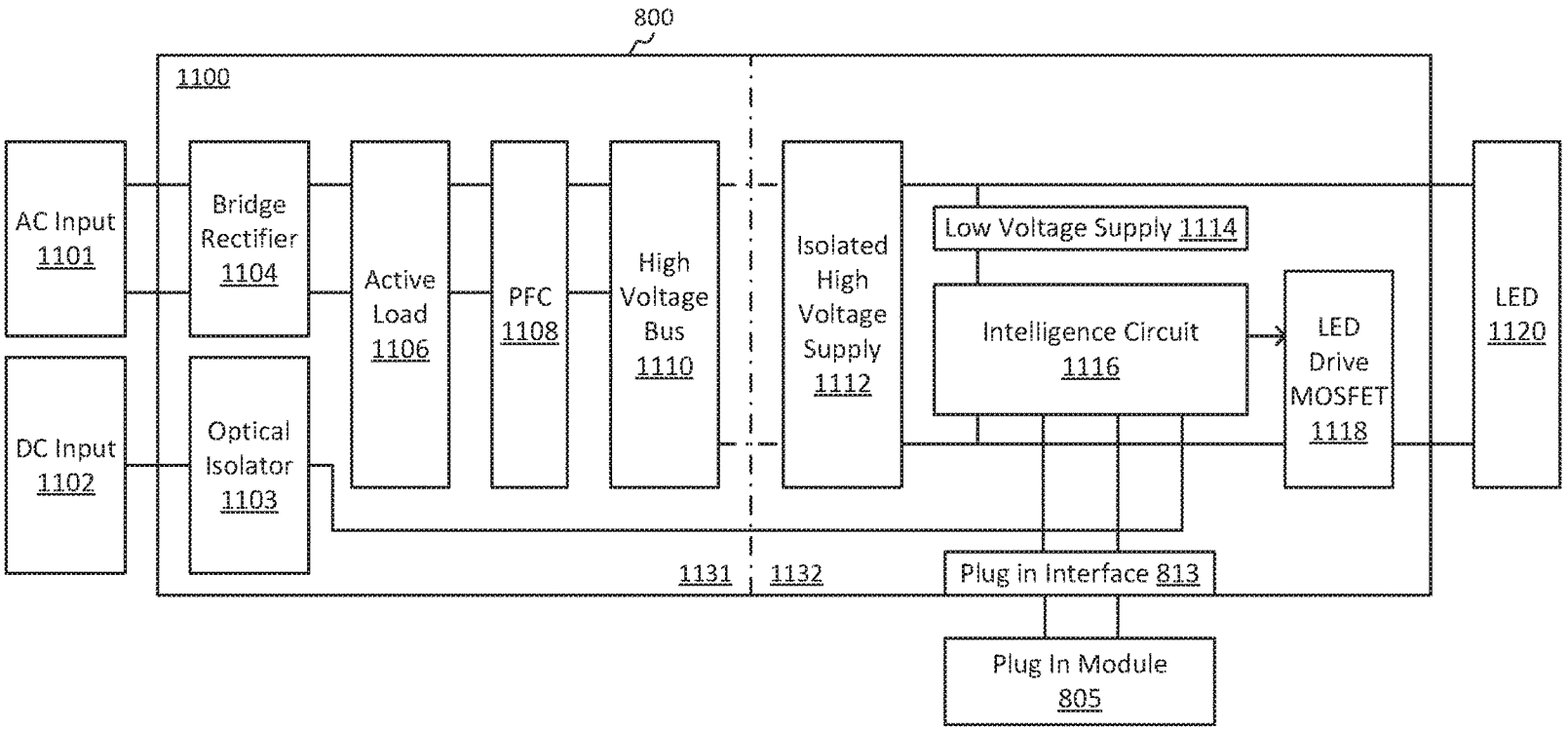

FIG. 11 is a block diagram of an LED driver circuit of the LED driver comprising a pluggable configuration module, in accordance with an illustrative embodiment.

Figure 12:
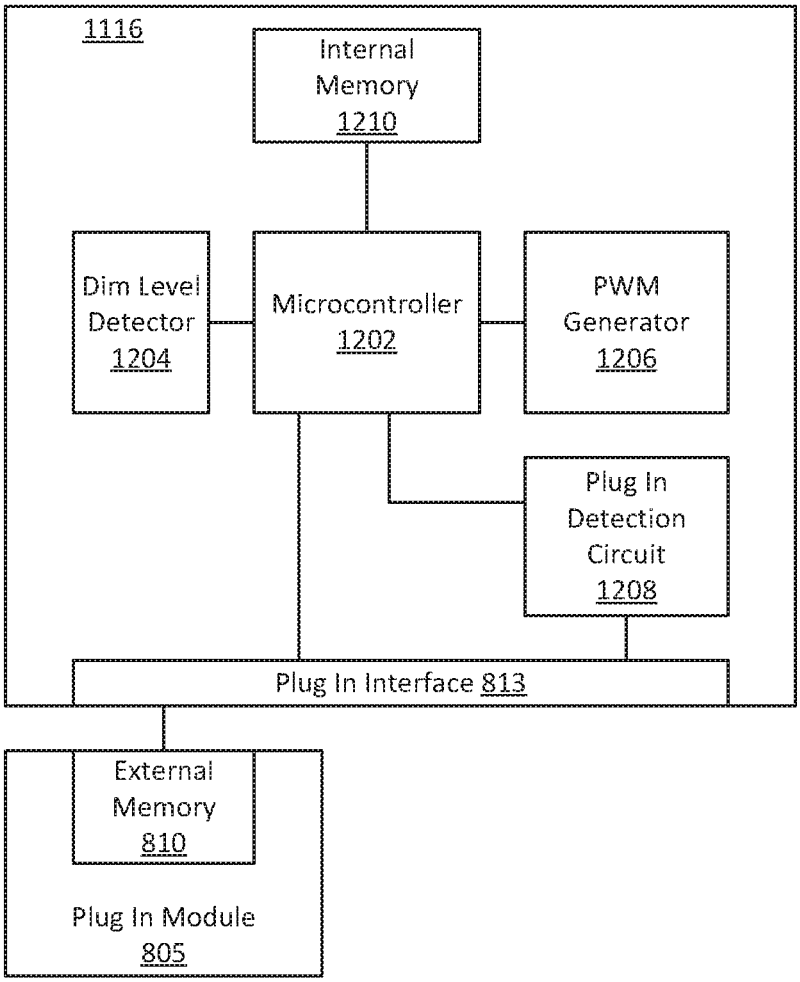

FIG. 12 is a block diagram of an intelligence circuit and of the pluggable configuration module of the LED driver, in accordance with an illustrative embodiment.

Figure 13:
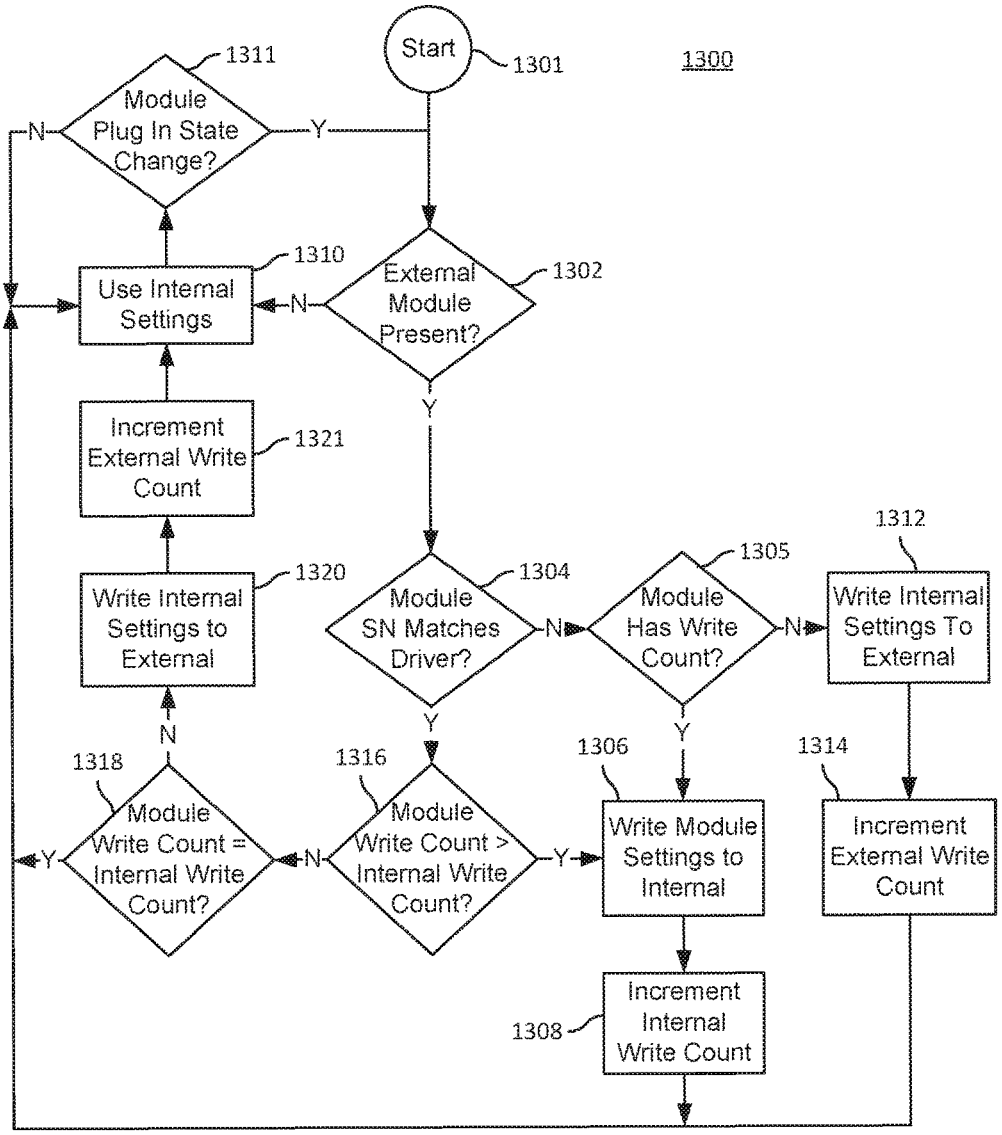

FIG. 13 is a flowchart illustrating steps for a method of configuring an LED driver, in accordance with an illustrative embodiment.

DETAILED DESCRIPTION OF THE INVENTION

The embodiments are described more fully hereinafter with reference to the accompanying drawings, in which embodiments of the inventive concept are shown. In the drawings, the size and relative sizes of layers and regions may be exaggerated for clarity. Like numbers refer to like elements throughout. The embodiments may, however, be embodied in many different forms and should not be construed as limited to the embodiments set forth herein. Rather, these embodiments are provided so that this disclosure will be thorough and complete, and will fully convey the scope of the inventive concept to those skilled in the art. The scope of the embodiments is therefore defined by the appended claims. The detailed description that follows is written from the point of view of a control systems company, so it is to be understood that generally the concepts discussed herein are applicable to various subsystems and not limited to only a particular controlled device or class of devices disclosed herein.

Reference throughout the specification to "one embodiment" or "an embodiment" means that a particular feature, structure, or characteristic described in connection with an embodiment is included in at least one embodiment of the embodiments. Thus, the appearance of the phrases "in one embodiment" on "in an embodiment" in various places throughout the specification is not necessarily referring to the same embodiment. Further, the particular feature, structures, or characteristics may be combined in any suitable manner in one or more embodiments.

LIST OF REFERENCE NUMBERS FOR THE ELEMENTS IN THE DRAWINGS IN NUMERICAL ORDER

The following is a list of the major elements in the drawings in numerical order.

10 AC Power Supply
11 Dimmer
12 LED Driver
13 LED Element
15 AC Power
17 Dimmed Hot Input Signal
19 Power Output
100 LED Driver Circuit
121 Bleed Resistor
122 Bridge Rectifier
123 Dimmed Input Sense
124 Bulk Power Storage
125 Class 2 Power Supply
126 Microcontroller
127 LED Dimming Circuitry
300 A Flowchart Illustrating Steps for a Method of Driving an LED Driver
301-304 Method Steps of Flowchart 300
400 LED Driver Circuit
402 Dimmer
404 Bridge Rectifier
406 Dimmed PWM Detector
408 Optical Isolator
410 Active Load
412 Power Factor Corrector
414 High Voltage Bus
416 Isolated High Voltage Power Supply
418 Low Voltage Supply
420 Microcontroller
422 PWM Duty Cycle Detector
424 PWM Duty Translator
426 PWM Regenerator
428 LED Drive MOSFET
430 LED Element
441 Dimmed Hot AC Voltage Signal
442 Rectified DC Voltage Bus Signal
448 High-Voltage Smoothed DC Voltage Output
450 Smoothed DC Voltage Bus Signal
452 Low-Voltage DC Signal
454 Low-Voltage DC Square Wave Signal
455 Detected Incoming Duty Cycle $D_{in}$
456 Generated Output Duty Cycle $D_{out}$
457 Generated PWM Signal
460 Generated Current
461 High-Voltage Side
462 Low-Voltage Side
541 Dimmed Hot AC Voltage Signal
542 Rectified DC Voltage Bus Signal
550 Smoothed DC Voltage Bus Signal
554 Low-Voltage DC Square Wave Signal
555 Detected Incoming Duty Cycle $D_{in}$
556 Generated Output Duty Cycle $D_{out}$
557 Generated PWM Signal
641 Dimmed Hot AC Voltage Signal
654 Low-Voltage DC Square Wave Signal
655 Detected Incoming Duty Cycle $D_{in}$
656 Generated Output Duty Cycle $D_{out}$
700 A Flowchart Illustrating the Steps for a Method of Generating an Output Duty Cycle $D_{out}$ Based On a Detected Incoming Duty Cycle $D_{in}$
701-714 Method Steps of Flowchart 700
800 LED Driver
801 LED Driver Housing
802 Housing Opening
803 Terminal Blocks
805 Plug-In Module
806 Printed Circuit Board (PCB)
807 Housing Portion
808 Upper Surface
810 Memory
811 First Recessed Portion
812 Second Recessed Portion
813 Plug-in Interface
814 Contact Pins
815 Contact Pads
900 A Flowchart Illustrating Steps for a Method of Providing an LED Driver
901-904 Method Steps of Flowchart 900
1000 A Flowchart Illustrating Steps for a Method of Configuring an LED Driver
1001-1007 Method Steps of Flowchart 900
1100 LED Driver Circuit
1101 AC Input
1102 DC Input
1103 Optical Isolator
1104 Bridge Rectifier
1106 Active Load
1108 Power Factor Corrector (PFC)
1110 High Voltage Bus
1112 Isolated High Voltage Power Supply
1114 Low Voltage Supply
1116 Intelligence Circuit
1118 LED drive MOSFET
1120 LED Element
1131 Low-Voltage Side
1132 High-Voltage Side
1202 Microcontroller
1204 Dim Level Detector
1206 PWM Generator
1208 Plug-in Detection Circuit
1210 Internal Memory

1300 Flowchart Illustrating Steps for a Method of Configuring an LED Driver

1301-1321 Method Steps of Flowchart 1300

LIST OF ACRONYMS USED IN THE SPECIFICATION IN ALPHABETICAL ORDER

The following is a list of the acronyms used in the specification in alphabetical order.

AC Alternating Current
ASICs Application Specific Integrated Circuits
CPU Central Processing Unit
DALI Digital Addressable Lighting Interface
DC Direct Current
EEPROM Electrically Erasable Programmable Read-Only Memory
FPC Forward Phase Control
F-RAM Ferroelectric Random-Access Memory
Hz Hertz
LE Leading Edge
LED Light Emitting Diode
NTC Negative Temperature Coefficient
PCB Printed Circuit Board
PFC Power Factor Corrector
PTC Positive Temperature Coefficient
PWM Pulse Width Modulation
RAM Random-Access Memory
RMS Root Mean Square
ROM Read-Only Memory
RPC Reverse Phase Control
TE Trailing Edge
V Volt

MODE(S) FOR CARRYING OUT THE INVENTION

For 40 years Crestron Electronics, Inc. has been the world's leading manufacturer of advanced control and automation systems, innovating technology to simplify and enhance modern lifestyles and businesses. Crestron designs, manufactures, and offers for sale integrated solutions to control audio, video, computer, and environmental systems. In addition, the devices and systems offered by Crestron streamlines technology, improving the quality of life in commercial buildings, universities, hotels, hospitals, and homes, among other locations. Accordingly, the systems, methods, and modes of the aspects of the embodiments described herein can be manufactured by Crestron Electronics, Inc., located in Rockleigh, N.J.

The present embodiments provide devices, systems, software, and methods for control of light emitting diodes (LEDs). More particularly, the present embodiments provide a driver circuit for an LED driver for application with a dimmer in a two-wire configuration that uses the dimmed signal as power for the LED and information dictating dimming levels of the LED. Additionally, the present embodiments provide a plug-in module that allows for convenient configuration of constant current LED drivers. While the different aspects of the embodiments described herein pertain to the context of an LED driver, they are not limited thereto, except as may be set forth expressly in the appended claims.

FIG. 1 shows an LED driver 12 for use in a two-wire application, in accordance with an illustrative embodiment. The LED driver 12 receives a dimmed input from a dimmer 11 and uses the dimmed input to control the power delivered to a light emitting diode (LED) element 13. The LED driver 12 may be employed in a two wire application in which a neutral wire is not present for connection to a dimmer. According to some embodiments, the LED driver 12 may be an external driver in electrical communication with the dimmer 11 and LED element 13. The dimmer 11 and LED element 13 may be provided by third-party suppliers. According to another embodiment, the LED driver 12 may be an internal driver integrated with the LED element 13.

An alternating current (AC) power source 10, such as an AC mains power source, supplies electric AC power 15. In an embodiment of the invention, the AC power source 10 supplies 120 Volt (V) 60 Hertz (Hz) AC mains residential power supply 15. In other embodiments, the AC power source 10 may supply power at a different voltage or frequency. For example, in another embodiment, the AC power source 10 may supply 220V 50 Hz AC mains power supply 15.

A dimmer 11 is connected in series with the AC power source 10 and receives the AC mains electric power 15. The dimmer 11 may be an off the shelf external dimmer provided by a third party supplier. The dimmer 11 is further configured for outputting a dimmed hot signal 17 to the LED driver 12. In an embodiment, the dimmer 11 comprises a phase controlled dimmer such as a triac. The dimmer 11 may be a leading edge (LE) or a forward phase control (FPC) dimmer, or it may be a trailing edge (TE) or a reverse phase control (RPC) dimmer. As such, the dimmed hot input signal 17 may be a forward phase dimming signal or a reverse phase dimming signal. The dimmer 11 further comprises a dimmer control circuit by which a user may adjust the duty cycle of the dimmer and thus control the lighting level of the lighting load.

The LED driver 12 receives the incoming dimmed hot signal 17 from the dimmer 11 at a dimmer hot terminal of the LED driver 12 and outputs an electric power output 19. The LED element 13 is illuminated via the electric power output 19 from the driver 12. The LED element 13 may comprise one or more LEDs or light sources disposed on a printed circuit board.

The LED driver 12 of the present embodiments uses the dimmed hot input signal 17 in two ways. Instead of translating the dimmed hot input signal 17 directly to the LED element 13, the LED driver 12 uses the dimmed hot signal 17 as both the power for the LED power supply and as a communications medium to control the LED element 13 at a desired intensity. The LED driver 12 comprises a front-end bulk capacitance to provide a constant power supply to the components of the LED driver 12 as well as to drive the LED element 13. Additionally, the front end of the LED driver 12 comprises a dimmed input sense circuit that reads the incoming dimmed hot signal 17 to infer the intended brightness of the LED element 13. The dimmed input sense circuit detects the incoming duty cycle of the dimmed signal and the LED driver 12 supplies power 19 to the LED element 13 accordingly. Specifically, the LED driver 12 comprises a microcontroller that reads the detected incoming duty cycle and uses logic to generate a duty cycle to control the LED element 13 at a desired intensity.

This implementation of the LED driver 12 of the present embodiments allows for consistent light output and dimming levels, including very low dim levels, on a standard dimmer input platform. Additionally, because the implementation of the LED driver 12 decouples the incoming duty cycle from the generated duty cycle that is actually being fed to the LED element 13, the LED driver 12 can feed a constant and stable current to the LED element 13. The microcontroller can implement software filtering on the duty cycle such that slight differences in firing angle at the front end of the LED driver 12 do not translate into the light output. Thus, if there are any inconsistencies on the ON time of the dimmed hot input signal 17, they get filtered out by the microcontroller. As such, the microcontroller can provide a stable light output from high dimming levels all the way down to low dimming levels by filtering out any incoming fluctuations. The microcontroller can also control the type of output it wants to achieve. For example, at very low dimming levels, the microcontroller can maintain the LED element 13 at a minimum dimming level until the microcontroller determines that enough power is supplied to continuously power the LED driver 12. For instance, sub one percent (1%) LED dimming can be the output when the on time of the dimmer is actually at fifteen percent (15%), as will be further described below. By using the dimmed input signal as a communication protocol instead of raw power delivery, the performance is limited only by the performance of the attached LED element 13. Additionally, by employing the first portion of the dimmed signal to power the electronics, performance issues at low end are negated. At high end, only a very small portion of the power from the power supply is used to feed the control circuitry of the LED drive circuit. Accordingly, there are no impacts to the level of brightness that can be achieved.

FIG. 2 is a block diagram of an LED driver circuit 100 of the LED driver 12 for dimming an LED element 13, according to an illustrative embodiment. The LED driver circuit 100 may comprise a bleed resistor 121, a bridge rectifier 122, a dimmed input sense circuit 123, a bulk power storage block 124, a class two power supply 125, an LED dimming circuit 127, and a microcontroller 126.

An AC power circuit supplies the dimmed hot signal 17 to the LED driver circuit 100. In an embodiment of the invention, the AC power circuit may comprise an AC mains power supply 10, a dimmer 11, and a bridge rectifier (as shown in FIG. 1). The dimmed hot signal 17 supplied by the AC power circuit may be a forward phase signal or a reverse phase signal.

The bleed resistor 121 is configured for discharging stored charge in the dimmer circuit.

The bridge rectifier 122 rectifies the AC mains voltage into a direct current (DC) voltage.

The dimmed input sense circuit 123 detects the duty cycle of the dimmed signal. The driver circuit 100 supplies power to the LED element 13 according to the duty cycle sensed by the dimmed input sense circuit 123. The dimmed input sense circuit 123 may detect the duty cycle directly or may infer from other variables of the waveform such as a switch-on time after zero cross, a voltage of switch-on time after zero cross, a switch-off time after zero-cross, a voltage of a switch-off time after zero cross, or any other waveform variable which may be used to detect duty cycle.

The driver circuit 100 communicates the sensed duty cycle to a microcontroller 126 for use in controlling LED dimming circuitry of the LED driver.

The bulk power storage 124 is configured for storing electric power between cycles of the AC power. The bulk power storage 124 outputs a smoothed DC voltage. The bulk power storage 124 may be one or more capacitors, one or more inductors or any combination of the two.

The power supply 125 converts the smoothed DC voltage output from the bulk power storage to a DC voltage suitable for powering the LED element and the microcontroller 126. In an embodiment of the invention, the power supply 125 is a Class 2 power supply.

The driver circuit 100 further comprises a microcontroller 126 in communication with LED dimming circuitry. The microcontroller 126 controls the LED dimming circuitry to dim the supplied power to the LED element 13. The microcontroller 126 controls the LED dimming circuitry 127 according to the sensed duty cycle. In an embodiment, the driver circuit further comprises a memory for storing configuration information for the LED driver for use by the microcontroller 126.

In an embodiment of the invention, the dimming circuitry 127 utilizes pulse width modulation (PWM) to the dim the output 19 to the LED element 13. The PWM may be used to control the voltage supplied to the LED element 13 or the current depending on the type of LED driver 12.

The LED element 13 receives the dimmed electric power output 19 from the driver circuit 100.

FIG. 3 is a flowchart 300 illustrating steps for a method of driving an LED driver 12, in accordance with an illustrative embodiment.

In step 301, a phase controlled dimmed AC signal 17 is received at a driver circuit 100 of LED driver 12. The phase controlled dimmed AC signal 17 may be a forward phase controlled or reverse phase controlled signal. In an embodiment of the invention, the phase controlled signal 17 is received from a dimmer 11 wired in a two-wire configuration.

In step 302, the duty cycle of the phase controlled dimmed AC signal 17 is determined. The driver circuit 100 determines the duty cycle by sensing one or more factors. In embodiments of the invention, the driver circuit 100 may detect the duty cycle directly or may infer from other variables of the waveform such as a switch-on time after zero cross, a voltage of switch-on time after zero cross, a switch-off time after zero-cross, a voltage of a switch-off time after zero cross, or any other waveform variable which may be used to detect duty cycle.

In step 303, the dimmed AC signal is converted to a DC signal for powering an LED element. The AC signal is stepped down, rectified, and smoothed to produce a DC voltage signal.

In step 304, the DC voltage is dimmed to a level corresponding to the duty cycle of the phase dimmed AC signal. The driver circuit 100 may dim the DC voltage by pulse width modulation.

FIG. 4 is a detailed block diagram of LED driver circuit 400 of an LED driver 12 for dimming an LED element 430 according to an illustrative embodiment. According to an embodiment the LED driver circuit 400 provides a constant-voltage type of driver 12. Although, the LED driver circuit 400 may be a constant-current type of driver. LED driver circuit 400 may comprise various circuit components, including, but not limited to a bridge rectifier 404, a dimmed PWM detector 406, an optical isolator 408, an active load 410, a power factor corrector (PFC) 412, high voltage bus 414, isolated high voltage power supply 416, low voltage supply 418, a microcontroller 420 (including a PWM duty cycle detector 422, a PWM duty translator 424, and a PWM regenerator 426), and a LED drive MOSFET 428. The functions these components may be dispersed through a plurality of circuit elements, or the functions of any two or more of these components may be integrated into a single circuit element.

Figure 5A:
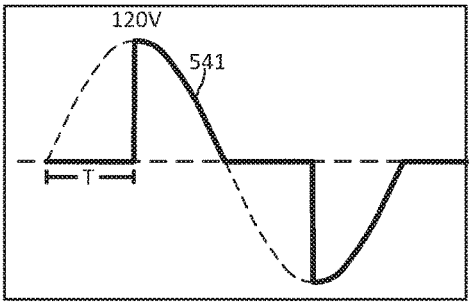

The LED driver circuit 400 receives a dimmed hot AC voltage signal 441. The dimmed AC voltage signal 441 is supplied by an AC mains power supply through a dimmer 402 and may be a forward phase signal or a reverse phase signal. For example, as shown in FIG. 5A, the dimmed AC voltage signal 441 may be a forward phase 120V 60 Hz signal 541 with power dimmed to approximately 50%. The dimmer 402 may comprise a triac, a thyristor, or a MOSFET that takes the incoming AC voltage and suppresses or shuts the voltage off for a period of time T of every half cycle. The period of time T corresponds to the dimming level. The longer the voltage is shut off for each half cycle, the dimmer is the output signal.

Figure 5B:
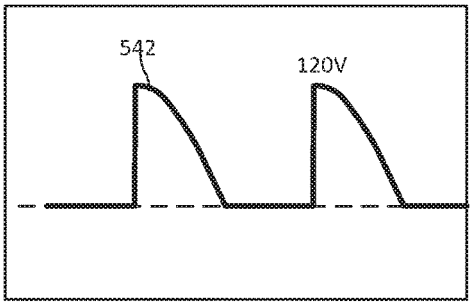
Figure 5C:
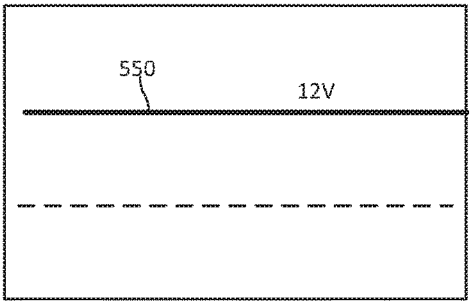
Figure 5D:
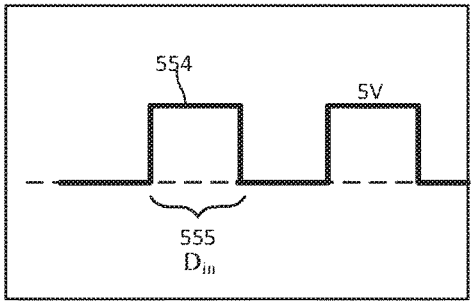

The bridge rectifier 404 rectifies the dimmed AC voltage signal 441 and converts it into a rectified DC voltage bus signal 442. For example, as shown in FIG. 5B, the AC voltage signal 541 is rectified to a DC voltage bus signal 542. The bridge rectifier 404 may comprise four or more diodes in a bridge circuit configuration which provides the same polarity output for either polarity input of the AC signal. The rectified DC voltage bus signal 442 is fed to the active load 410 and the dimmed PWM detector 406, in the first instance to be used as the power for the LED power supply and in the second instance as a communications medium to control the LED element 13 at a desired intensity, respectively.

The active load 410, PFC 412, high voltage bus 414, and the isolated high voltage power supply 416 convert the rectified DC voltage bus signal 442 into a smoothed DC voltage bus signal 450 to continuously power the LED element 430 as well as the microcontroller 420 throughout the entire cycle of the dimmed AC voltage signal 441. The active load 410, PFC 412, high voltage bus 414, and the isolated high voltage power supply 416 may be part of the bulk power storage 124 discussed above configured for storing electric power between cycles of the AC power to provide the smoothed DC voltage bus signal 450. Thus, although the dimmed AC voltage signal 441 may be turned off for a period of time T, the LED element 430 and the microcontroller 420 are receiving continuous power. This effectively eliminates the perceivable "dropout" periods of the LED element 430.

Particularly, the active load 410 comprises a circuit configured for regulating the current. The active load 410 circuit may comprise active devices, such as MOSFETs, transistors, resistors, or the like. The active load 410 functions as a current-stable nonlinear resistor that behaves as a dynamic resistor changing its resistance to compensate for current variations. The active load 410 will present a constant load to the dimmer 402 to keep the dimmer 402 above the shut off current level such that a constant power supply is provided. The active load 410 may be configured to present to the dimmer 402 a slightly larger load than necessary to ensure constant power supply.

The power factor corrector (PFC) 412 comprises a circuit for correcting the power factor of the LED driver circuit 400 to as close to unity or 1. The power factor corrector (PFC) 412 adjusts the voltage and current waveforms that are distorted and not in phase to oscillate in sync such that all the power taken from the source is used by the load and does not get lost. This increases the efficiency of the LED driver circuit 400.

The high voltage bus 414 is configured for providing temporary power storage. The high voltage bus 414 circuit may comprise a large capacitor and a diode. The high voltage bus 414 produces a high-voltage smoothed DC voltage output 448. For example, the capacitor may be a 160V capacitor that produces approximately 160V smoothed DC output 448. The diode included in the high voltage bus 414 ensures that the capacitor voltage does not the impact the dimmed PWM detector 406.

The isolated high voltage power supply 416 is configured for providing a smoothed DC voltage bus signal 450 for powering the LED element 430 and microcontroller 420. The isolated high voltage power supply 416 isolates the high-voltage side 461 from the low-voltage side 462 of the LED driver circuit 400 for safety and to suppress electrical noise to protect the LED element 430 and microcontroller 420 from line-voltage fluctuations. Additionally, the isolated high voltage power supply 416 may comprise a transformer that transforms the high-voltage smoothed DC voltage output 448 to the smoothed DC voltage bus signal 450 at a voltage level suitable for powering the LED element 430 and microcontroller 420. For example, the isolated high voltage power supply 416 may be a Class 2 power supply that generates up to 60V smoothed DC bus signal 450 at a high current. The voltage level outputted by the power supply 416 will depend on the voltage required by the LED element 430. For example, the smoothed DC voltage bus signal 450 may comprise a 12V DC bus signal 550 shown in FIG. 5C. The smoothed DC voltage bus signal 450 may comprise other voltage values, including, but not limited to, 6V DC, 9V DC, 10V DC, 24V DC, 28V DC, 36V DC, or any other voltage value required by the LED element 430.

The LED driver circuit 400 may further comprise a low voltage supply 418. The low voltage supply 418 may include a transformer that transforms the smoothed DC voltage bus signal 450 to a low-voltage DC signal 452 for powering the microcontroller 420. For example, the low-voltage DC signal 452 may comprise 3.3V DC signal.

As discussed above, the rectified DC voltage bus signal 442 from the bridge rectifier 404 at the front end of the LED driver circuit 400 is also fed to the dimmed PWM detector 406. The PWM detector 406 and the optical isolator 408 may be part of the dimmed input sense circuit 123. According to an embodiment, the PWM detector 406 is located in front of the PFC 412 and any high voltage supplies 414/416. This allows the LED driver circuit 400 to generate an accurate pulse width modulated signal from the incoming dimmed AC voltage signal 441 that is fed into the microcontroller 420 to regulate the LED element 430. The PWM detector 406 detects the duty cycle of the rectified dimmed DC voltage bus signal 442. A duty cycle is the percentage of one period in which a signal is ON or active. As discussed above, the PWM detector 406 may detect the duty cycle directly or may infer it from other variables of the waveform such as a switch-on time after zero cross, a voltage of switch-on time after zero cross, a switch-off time after zero-cross, a voltage of a switch-off time after zero cross, or any other waveform variable which may be used to detect duty cycle. According to an embodiment, the PWM detector 406 may comprise a resistor divider into a transistor to determine the actual ON time that the dimmer is presenting to the LED Driver 12. The PWM detector outputs a low-voltage DC square wave signal 454 comprising the detected duty cycle. For example, for rectified dimmed DC voltage bus signal 542 at 50% dimming level shown in FIG. 5B, the dimmed PWM detector may output a 5V DC square wave signal 554 shown in FIG. 5D.

The optical isolator 408 is used to transmit the low-voltage square wave signal 454 from the high-voltage side 461 to the microcontroller 420 on the low-voltage side 462 of the LED driver circuit 400, while keeping the low-voltage side 461 and the high-voltage side 462 isolated. An optical isolator 408 may be passive magneto-optic device that may comprise an optical diode to allow light to travel in a single direction.

The microcontroller 420 receives the low-voltage square wave signal 454 indicating the detected duty cycle. The microcontroller 420 may comprise at least one central processing unit (CPU) that can represent one or more microprocessors, "general purpose" microprocessors, special purpose microprocessors, application specific integrated circuits (ASICs), or any combinations thereof. The CPU can provide processing capabilities for one or more of the techniques and functions described herein. The microcontroller 420 may also comprise a memory that can store data and executable code, such as volatile memory, nonvolatile memory, read-only memory (ROM), random-access memory (RAM), electrically erasable programmable read-only memory (EEPROM), flash memory, a hard disk drive, or other types of memory. Furthermore, the microcontroller 420 may comprise one or more modules, such as the PWM duty cycle detector 422, PWM duty translator 424, and PWM regenerator 426 to control the LED dimming circuitry 428 according to the sensed duty cycle. According to an embodiment the modules of the microcontroller 420 are implemented in software stored in the memory and executed by the microprocessor. However, according to another embodiment, the microcontroller 420 or one or more of the modules of the microcontroller 420 can be implemented in hardware.

Once the microcontroller 420 receives the sensed or detected duty cycle indicated by the low-voltage square wave signal 454, and thereby the "desired intensity", the microcontroller 420 can use it in a variety of ways to achieve the optimal result as discussed below.

The PWM duty cycle detector 422 translates the low-voltage square wave signal 454 to a percentage value indicating the detected incoming duty cycle $D_{in}$ 455 that corresponds to the incoming dimming level received from the dimmer 402. $D_{in}$ 455 is the percentage of one period in which the signal is active or ON. $D_{in}$ 455 may be determined by dividing the time the signal is active or ON by the total period of the signal cycle and multiplying that number by 100. According to an embodiment, $D_{in}$ 455 may range anywhere from a value just above 0% to about 100%. At 0% the LED driver circuit 400 will simply be OFF and unpowered. When the LED driver circuit 400 receives a minimum amount of power, that would translate to $D_{in}$ 455 of above 0%, for example 0.01%, 0.1%, or 1.0%. In the example illustrated in FIG. 5D, the low-voltage square wave signal 554 that indicates an ON time of 50% would be translated to approximately a 50% duty cycle value $D_{in}$ 555.

The PWM duty translator 424 may be configured for generating an output duty cycle $D_{out}$ 456 from the detected incoming duty cycle $D_{in}$ 455 by implementing logic to filter out any differences in voltage fluctuations. The PWM duty translator 424 may clamp the low-end dimming level to provide a stable light intensity output. When the PWM duty translator 424 receives a detected incoming duty cycle $D_{in}$ 455 that falls below a low-level duty cycle threshold $D_{Lth}$, the PWM duty translator 424 may clamp the output to generate an output duty cycle $D_{out}$ 456 equal to a minimum duty cycle output value $D_{min}$. The low-level duty cycle threshold $D_{Lth}$ may correspond to a duty cycle below about 15%. The minimum duty cycle output value $D_{min}$ may comprise approximately 0.1%. Thus, when the PWM duty translator 424 receives a detected incoming duty cycle $D_{in}$ 455 with a value anywhere below about 15%, the PWM duty translator 424 will generate a 0.1% output duty cycle $D_{out}$ 456. As a result, the microcontroller 420 artificially keeps the LED element 430 at a low power (i.e., very dim) until the detected incoming duty cycle $D_{in}$ exceeds the low-level duty cycle threshold $D_{Lth}$ of about 15%. This will ensure that that the high voltage power supply 416 is sufficiently charged to provide enough power to keep a consistent dim level. As such, this will eliminate the LED element 430 from flickering at low-end because the power supply 416 is insufficiently charged. Additionally, this allows the LED driver circuit 400 to keep the dimmed output at much lower brightness than the currently available LED drivers.

Similarly, the PWM duty translator 424 may be configured for clamping the high-end dimming level to provide stable output light intensity. When the PWM duty translator 424 receives a detected incoming duty cycle $D_{in}$ 455 that exceeds a high-level duty cycle threshold $D_{Hth}$, the PWM duty translator 424 may clamp the output to generate an output duty cycle $D_{out}$ 456 equal to a maximum duty cycle output value $D_{max}$. The high-level duty cycle threshold $D_{Hth}$ may correspond to a duty cycle above about 90%. The maximum duty cycle output value $D_{max}$ may comprise approximately 100%. Thus, when the PWM duty translator 424 receives a detected incoming duty cycle $D_{in}$ 455 with a value anywhere between about 90% to about 100%, the PWM duty translator 424 will generate a 100% output duty cycle $D_{out}$ 456. As a result, the microcontroller 420 artificially keeps the LED element 430 at a high end (i.e., full brightness) even in the event that the line voltage is moving around. This high-end clamping will eliminate the LED element 430 from flickering. Although this implementation requires an over design in the power supply to account for delivering full rating at 100%, while the LED driver circuit 400 may only be receiving 90% of power, that impact is minimal.

A detected incoming duty-cycle $D_{in}$ 455 that falls between the low-level duty cycle threshold $D_{Lth}$ of about 15% and the high-level duty cycle threshold $D_{Hth}$ of about 90% may be scaled by the PWM duty translator 424 to generate an output duty cycle $D_{out}$ 456 between a low end rescale value $S_L$ and a high end rescale value $S_H$. According to an embodiment, the detected incoming duty cycle $D_{in}$ may be rescaled to be between about 0.1% and about 100%. For example, to generate even dimming, the detected incoming duty-cycle $D_{in}$ may be evenly scaled using the following formula:

$$D_{out} = \frac{(D_{Hth} - D_{Lth})(D_{in} - S_L)}{(S_H - S_L)} + D_{Lth} \qquad \text{Formula 1}$$

where, $D_{in}$ is a detected incoming duty cycle, $D_{out}$ is a generated output duty cycle, $D_{Lth}$ is a low-level duty cycle threshold value (for example 15%), $D_{Hth}$ is a high-level duty cycle threshold value (for example 90%), $S_L$ is a low end rescale value (for example 100%), and $S_H$ is a high end rescale value (for example 0.1%).

However, the PWM duty translator 424 may rescale the detected incoming duty-cycle $D_{in}$ 455 to generate other output duty cycle $D_{out}$ 456 according to different methodologies. For example, the PWM duty translator 424 may utilize a look up table to determine the output duty cycle $D_{out}$ 456.

According to an embodiment, the high-level duty cycle threshold value $D_{Hth}$ is greater than the low-level duty cycle threshold value $D_{Lth}$. According to an embodiment, the low end rescale value $S_L$ is equal to the minimum duty cycle output value $D_{min}$, and the high end rescale value $S_H$ is equal to the maximum duty cycle output value $D_{max}$. According to another embodiment, these values may be different. Additionally, other values than the ones described above may be used by the microcontroller 420 for the low-level duty cycle threshold $D_{Lth}$, the high-level duty cycle threshold $D_{Hth}$, the minimum duty cycle output level $D_{min}$, the maximum duty cycle output level $D_{max}$, the low end rescale value $S_L$, or the high end rescale value $S_H$. According to another embodiment, the microcontroller 420 may be reprogrammed with the desired low-level duty cycle threshold $D_{Lth}$, high-level duty cycle threshold $D_{Hth}$, minimum duty cycle output $D_{min}$, maximum duty cycle output $D_{max}$, low end rescale value $S_L$, and/or high end rescale value $S_H$.

The low-level duty cycle threshold $D_{Lth}$ may comprises a value within a range from above 0% to about 30%. For example, the low-level duty cycle threshold $D_{Lth}$ may be about 10%, about 5%, or about 3%. The low end rescale value $S_L$ and the minimum duty cycle output value $D_{min}$ may comprises a value within a range from above 0% to about 20%. For example, the low end rescale value $S_L$ and the minimum duty cycle output value $D_{min}$ may be 0.001%, 0.01%, 1%, or 2%. The high-level duty cycle threshold $D_{Hth}$ may comprise a value within a range from about 70% to below 100%. For example, the high-level duty cycle threshold $D_{Hth}$ may be about 85%, about 95%, or about 97%. The high end rescale value $S_H$ and the maximum duty cycle output value $D_{max}$ may comprise a value within a range from about 80% to below 100%. For example, the high end rescale value $S_H$ and the maximum duty cycle output value $D_{max}$ may be 90%, 95% or 99%.

FIG. 7 is a flowchart 700 illustrating the steps for a method of generating an output duty cycle $D_{out}$ based on a detected incoming duty cycle $D_{in}$ in accordance with an illustrative embodiment. In step 701, the microcontroller 420 may store various dimming level parameters for generate the output duty cycle $D_{out}$. Particularly, the microcontroller 20 may comprise memory that stores predetermined values for the desired low-level duty cycle threshold $D_{Lth}$, high-level duty cycle threshold $D_{Hth}$, minimum duty cycle output $D_{min}$, maximum duty cycle output $D_{max}$, low end rescale value $S_L$, and high end rescale value $S_H$. As discussed above, these values may be programmed either by a supplier, a technician, by the user, or the like.

In step 702, the microcontroller 420 receives a low-voltage square wave signal 454 from the dimmed PWM detector 406. In step 704, the microcontroller determines the detected incoming duty cycle value $D_{in}$ 455.

In step 706, the microcontroller 420 determines whether the incoming duty cycle value $D_{in}$ 455 is below the low-level duty cycle threshold $D_{Lth}$. If the incoming duty cycle value $D_{in}$ 455 is below the low-level duty cycle threshold $D_{Lth}$, then in step 708 the generated output duty cycle $D_{out}$ is set to a minimum duty cycle output value $D_{min}$. Reference is now made to an example shown in FIGS. 6A-6C where the low-level duty cycle threshold $D_{Lth}$ is about 15% and the LED circuit 400 receives a dimmed hot AC voltage signal 641 at a low-end dimming level that corresponds to a detected incoming duty-cycle $D_{in}$ 655 of about 10%. Since the detected incoming duty cycle $D_{in}$ 655 falls below the low-level duty cycle threshold $D_{Lth}$ of about 15%, the PWM duty translator 424 will clamp the output to generate a 0.1% output duty cycle $D_{out}$ 656.

Referring back to FIG. 7. If the incoming duty cycle value $D_{in}$ 455 is above or equal the low-level duty cycle threshold $D_{Lth}$, then in step 710 the microcontroller 420 determines whether the incoming duty cycle value $D_{in}$ 455 is above the high-level duty cycle threshold $D_{Hth}$. If the incoming duty cycle value $D_{in}$ 455 is above the high-level duty cycle threshold $D_{Hth}$, then in step 712 the generated output duty cycle $D_{out}$ is set to a maximum duty cycle output value $D_{max}$. For example, where $D_{Hth}$ is set to 90%, the $D_{max}$ is set to 100%, and the PWM duty translator 424 receives an incoming duty cycle value $D_{in}$ 455 of about 95% (above the high-level duty cycle threshold $D_{Hth}$), then the PWM duty translator 424 will clamp the output to generate a 100% output duty cycle $D_{out}$.

Figure 5E:
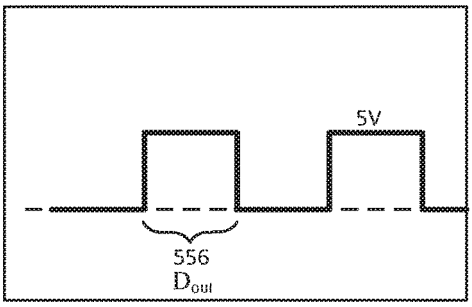

If the incoming duty cycle value $D_{in}$ 455 is below or equal to the high-level duty cycle threshold $D_{Hth}$ (and above or equal to the low-level duty cycle threshold $D_{Lth}$), then in step 714 the microcontroller 420 rescales the incoming duty cycle value $D_{in}$ 455 to an output duty cycle $D_{out}$ 456. For example, the microcontroller 420 may evenly resale the incoming duty cycle value $D_{in}$ 455 between a low end rescale value $S_L$ and a high end rescale value $S_H$ according to Formula 1. Referring to the example shown in FIG. 5D, the low end rescale value $S_L$ may be 0.1%, the high end rescale value $S_H$ may be 100%, the high-level duty cycle threshold $D_{Hth}$ may be about 90%, the low-level duty cycle threshold $D_{Lth}$ may be about 15%, and the detected incoming duty cycle $D_{in}$ 555 may be 50%. Since the detected incoming duty cycle $D_{in}$ 555 of 50% is outside of both the low-level and the high-level duty cycle thresholds, the detected incoming duty cycle $D_{in}$ 555 would be rescaled to generate a duty cycle between about 0.1% and about 100%. Particularly, applying Formula 1, the incoming duty cycle $D_{in}$ 555 would be rescaled to generate a duty cycle 556 of about 52.46% as shown in FIG. 5E.

Figure 5F:
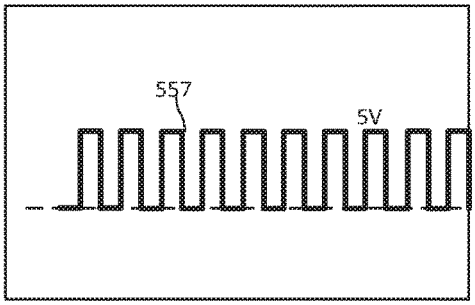

Referring back to FIG. 4, after generating the desired output duty cycle $D_{out}$ 456, the PWM regenerator 426 of the microcontroller 420 generates a new PWM signal 457 from the generated output duty cycle $D_{out}$ 456. According to an embodiment, the PWM regenerator 426 generates a PWM signal 457 at a higher frequency so that it is much faster. For example, as shown in FIGS. 5E-5F, the PWM regenerator 426 may use the generated output duty cycle $D_{out}$ 556 to generate a PWM signal 557 at a higher frequency. According to an embodiment, the frequency is increased to above frequencies perceivable to a human eye. According to another embodiment, the frequency is increased to above frequencies capable of being detected by an optical device, such as a camera. In one embodiment, the frequency is increased to about 1 KHz. The higher frequency will remove any perceivable flickering that may be perceived via a human or an optical device.

As shown in FIG. 4, the PWM signal 457 is fed to the LED drive MOSFET 428 that generates current 460 to driver the LED element 430 based on the PWM signal 457. The generated current 460 will vary based on the dimming level generated by the microcontroller 420 based on the sensed incoming duty cycle.

Additionally, the present embodiments provide a plug-in module that allows for convenient configuration and replacement of LED drivers, including constant current LED drivers. While the different aspects of the embodiments described herein pertain to the context of an LED driver, they are not limited thereto, except as may be set forth expressly in the appended claims. FIG. 8 shows an LED driver 800 with a removably pluggable configuration module or plug-in module 805, comprising configuration information for the LED driver 800, according to an illustrative embodiment. The LED driver 800 comprises a driver housing 801 and one or more LED driver circuits disposed therein, as will be described below, configured to control the power delivered to a light emitting diode (LED) element or fixture. For example, LED driver 800 can comprise similar configuration to the GLD-LED Crestron Green Light® Dimmable LED Driver, available from Crestron Electronics, Inc. of Rockleigh, N.J.

The LED driver 800 further comprises terminal blocks 803 comprising a plurality of inputs and outputs configured for receiving a plurality of electrical connections to connect the LED driver 800 to various electronic devices. According to an embodiment, the terminal blocks 803 may comprise push-in connectors, spring clip connectors, screw terminals, or the like, for receiving electrical wires. In another embodiment, the LED driver 800 may comprise wires extending therefrom for connection with the electronic devices.

Particularly, the terminal blocks 803 may comprise one or more outputs configured to connect the LED driver 800 to one or more LED elements or fixtures via one or more wires. According to an embodiment, to support a wide variety of fixture configurations, the LED driver 800 may comprise multiple outputs, or channels, with independent LED current settings. While the outputs may be controlled as one, the output current for each can be separately configured using the methods described herein.

The terminal blocks 803 may further comprise one or more inputs configured for receiving power and control signals. For example, one or more inputs may comprise a power input, such as a 120-277V input, for line, neutral, and ground connections. In another embodiment, the terminal blocks 803 may comprise a low voltage (e.g., 0-10V) input connection to receive low voltage control input. The LED driver 800 may receive control inputs from various control devices, such as, but not limited to, occupancy sensors, daylight sensors, thermostats, gateways, control systems, keypads, switches, dimmers, or the like.

In another embodiment, the terminal blocks 803 may comprise one or more inputs for interfacing with a Digital Addressable Lighting Interface (DALI) bus for communication with various lighting control devices via the DALI lighting control protocol. DALI allows multiple lighting fixtures to be networked using a single daisy-chained control wire. Up to 64 fixtures can exist on a single DALI channel. DALI provides a bidirectional interface enabling independent control and monitoring of each individual fixture. DALI is optimal for use in applications that require granular control of each fixture, such as open office floor plans, audiovisual-equipped conference rooms, and daylight harvesting.

In an embodiment, the removably pluggable configuration module 805 comprises a housing portion 807 and a printed circuit board (PCB) 806. According to an embodiment shown in FIG. 8, the housing portion 807 may comprise a substantially flat upper surface 808 and the PCB 806 may transversely extend from the housing portion 807. According to various aspects of the embodiments, the housing portion 807 may comprise plastic, metal, fiberglass, or other materials known to those skilled in the art. The PCB 806 may comprise a plurality of contact pads 815 disposed on a distal end of the PCB 806 opposite from the housing portion 807 and configured for connecting to the LED driver 800 through a plug-in interface 813.

The LED driver 800 may comprise a driver housing 801 and an opening 802 disposed on the surface of the driver housing 801 for receiving the plug-in module 805. According to an embodiment, the opening 802 may comprise a first recessed portion 811 inwardly extending from the outer surface of the driver housing 801. The first recessed portion 811 may be sized and shaped to receive the housing portion 807 of the pluggable configuration module 805. The opening 802 may further comprise a second recessed portion 812 which may inwardly extend from either the outer surface of the driver housing 801 or from the first recessed portion 811. The second recessed portion 812 may be sized and shaped to receive the PCB 806.

In the embodiment shown, the housing 801 of the LED driver 800 receives the plug-in module 805 such that the PCB 806 is internal to the housing 801 of the driver 800 and the upper surface 808 of the housing portion 807 is substantially flush with the outer surface of the LED driver housing 801. The first recessed portion 811 may be sized and shaped to receive the housing portion 807 of the plug-in module 805 in the substantially flush configuration. According to an embodiment, the housing portion 807 of the plug-in module may be "keyed" to mate with the opening 802 in the driver housing 801. For example, the housing 807 of the plug-in module may comprise a "T" shape, while the first recessed portion 811 also comprises a "T" shape sized to receive the plug-in module 805. However, other shapes may be used. A tab may be used to enable removal of the plug-in module 805. However, in an alternate embodiment, the PCB 806 and/or the housing portion 807 carrying the PCB 806 may partially extend from the outer surface of the driver housing 801. In another embodiment, the PCB 806 and/or the housing portion 807 carrying the PCB 806 may be external to the housing 801 of the LED driver 800 and may be plugged in to the LED driver 800 using a plug.

While a rectangular external LED driver 800 is shown with substantially flat outer surface, other shapes and types of LED drivers and plug-in modules may be provided. For example, the LED driver 800 may be an internal LED driver and part of an LED bulb having a shape of a standard incandescent bulb. The housing portion 807 of the plug-in module 805 may comprise a size, shape, and surface that complements the LED driver shape.

Referring back to FIG. 8, the opening 802 further comprises a plug-in interface 813 configured for allowing for electrical connection between the PCB 806 and one or more components of the LED driver 800, such as the LED driver circuit 1100 shown in FIG. 11. According to an embodiment, the plug-in interface 813 may comprise a plurality of pins disposed within the second recessed portion 812 that are connected to the LED driver circuit 1100. The PCB 806 may comprise a plurality of contact pads 815 configured for contacting the plurality of contact pins 814 when the PCB 806 is fully inserted in the second recessed portion 812. According to an embodiment, the plug-in interface 813 may comprise a proprietary plug-in interface, such as the CREScode™ interface, available from Crestron Electronics, Inc. of Rockleigh, N.J. According to another embodiment, the plug-in interface 813 may comprise a standard interface, such as a serial port, a RJ45 interface, a Universal Serial Bus (USB) interface, a mini-USB, a micro-USB, as well as other interfaces.

The pluggable module 805 with PCB 806 is configured for being inserted and removed from the LED driver opening 802 and interface 813. Upon insertion, the PCB 806 may be in electrical connection with the LED driver circuit 1100. Alternatively, the user may need to engage the PCB 806 with the LED driver circuit 1100 to enable electrical connection. For example, the user may need to mechanically engage the PCB 806 with the LED driver, such as via a lever action.

The PCB 806 comprises a memory 810 configured for storing configuration information for the LED driver 800. According to an embodiment, the memory 810 may comprise nonvolatile memory comprising any suitable nonvolatile storage medium, such as read-only memory (ROM), electrically erasable programmable read-only memory (EEPROM), Flash memory, ferroelectric RAM (F-RAM), a magnetic storage device such as a hard disc drive, or other types of memory. Being well-suited for long-term storage and not being prone to failure, the nonvolatile memory 810 can reliably store configuration information for the LED driver 800. The configuration information may comprise all the information that may be customizable. For a constant current LED driver, the configuration information may comprise the current level for the LED driver output as well as network configuration information or commissioning settings, such as DALI settings, for the LED driver 800. For example, in an embodiment, the PCB 806 may comprise DALI communication and network settings (i.e., network configuration information) for the LED driver 800. According to another embodiment, the PCB memory 810 may store predetermined values for the desired low-level duty cycle threshold $D_{Lth}$, the high-level duty cycle threshold $D_{Hth}$, the minimum duty cycle output $D_{min}$, the maximum duty cycle output $D_{max}$, the low end rescale value $S_L$, and the high end rescale value $S_H$, as discussed above.

When inserted in the LED driver 800, the PCB 806 may be in communication with a microcontroller of the LED driver 800. The microcontroller is configured for regulating electric power to an LED element according to the configuration information stored on the memory 810 of the printed circuit board 806.

Advantageously, a manufacturer may configure the LED driver 800 by plugging in a PCB 806 as opposed to programming the LED driver 800 with software tools. According to an embodiment, a first manufacturer may supply the LED driver 800 and a second manufacturer may supply the pluggable configuration module 805. The second manufacturer may supply the pluggable configuration module 805 containing the PCB 806 to the first manufacturer who may then distribute the combined LED driver 800 and the pluggable configuration module 805 containing the PCB 806 to a market. Advantageously, the first manufacturer may not have to program with software tools or ship to the second manufacturer. In an embodiment, the PCB 806 further comprises network configuration information, such as DALI information for the LED driver 800. A manufacturer may store the DALI information on the PCB 806 or a user may store the DALI information on the PCB 806.

Advantageously, the custom configuration information stored on memory 810 of the plug-in module 805 is not lost when the LED driver 800 fails. The plug-in module 805 of the failed LED driver 800 may be removed and plugged into a replacement, off-the-shelf, LED driver 800. The custom configuration information from the plug-in module 805 may then be used by the replacement LED driver 800. The replacement LED driver 800 may accordingly re-impersonate the failed LED driver 800. Accordingly, no custom LED driver needs to get ordered and failed LED drivers 800 may no longer require soft-addressing in the field as a pluggable PCB comprising the current level and/or commissioning information (e.g., DALI information) may be inserted into the LED driver 800. According to an embodiment, upon installation, the configuration information is also transmitted to the internal memory of the LED driver 800. Accordingly, in the instance the plug-in module 805 fails, the configuration information is saved on the internal memory and can be transmitted to a replacement plug-in module 805.

FIG. 9 is a flowchart 900 illustrating steps for a method of providing an LED driver, in accordance with an illustrative embodiment of the invention. In step 901, a first manufacturer may produce an LED driver 800 and a plug-in module 805. The LED driver 800 comprises a driver circuit 1100 contained in a driver housing 801. In an embodiment, the LED driver circuit 1100 comprises bleed resistor, a bridge rectifier, a dimmed input sense circuit, a bulk power storage block, a class two power supply, an LED dimming circuit and a microcontroller, as discussed above. The driver housing 801 further comprises an opening 802 for receiving the pluggable module 805 containing the PCB 806.

A second manufacturer, such as a fixture manufacturer, may procure and receive the LED driver 800 and the plug-in module 805 containing the PCB 806 from the first manufacturer. In step 902, the second manufacturer may program the plug-in module 805 with configuration information, which is stored on memory 810 of the PCB 806. The configuration information may comprise ratings required for the LED driver 800 to drive one or more LED elements of a fixture manufactured by the second manufacturer. For example, the configuration information may comprise the current level for the LED driver output as well as DALI settings for the LED driver 800.

In step 903, the second manufacturer inserts the pluggable module 805 containing the PCB 806 into the LED driver 800. The pluggable PCB 806 forms an electrical connection with the LED driver 800 upon insertion. In an embodiment, the pluggable module 805 containing the PCB 806 must be engaged with the LED driver 800 to be mechanically secured or create an electrical connection with PCB 806. For example, the first manufacturer may engage the PCB 806 mechanically. The second manufacturer then inserts the combined LED driver 800 and the plug-in module 805 into the fixture it manufactured.

In step 904, the second manufacturer brings its fixture, including the combined LED driver 800 and pluggable module 805 comprising the PCB 806, to market. For example, the second manufacturer may sell the fixture to a third company, such as a supplier, that may install the fixture at a consumer's facility. According to an embodiment, during installation, the third company may further program the plug-in module 805 with additional configuration information. For example, the third company may program the plug-in module 805 with network configuration information, such as DALI commissioning settings, including fixture group assignments (indicating which lighting group the fixture belongs to), lighting scene values or dimming levels, fading time (adjustment of dimming time or speed from one light level to next), hold time (period of time for holding one level), or the like. Replacement parts for the LED driver 800, including the plug-in module 805, may be ordered from the first manufacturer.

FIG. 10 is a flowchart 1000 illustrating steps for a method of replacing a pluggable configuration module 805 of an LED driver 800, in accordance with an illustrative embodiment of the invention. In step 1001, a fault is noted with a first LED driver 800 with a first pluggable module 805 containing a first PCB 806. A fault may be any circumstance in which the first LED is not operating as intended or expected. In step 1002, the first pluggable module 806 containing the first PCB 806 is removed from the first LED driver 800.

In step 1003, it is determined whether the first PCB 806 of the first LED driver 800 is damaged. In step 1004, if the first PCB 806 has not been damaged, the first plug-in module 805 containing the first PCB 806 is inserted into a second LED driver 800. Advantageously, the configuration information such as current level information and commissioning settings (e.g., DALI settings) may be transferred to the second LED driver 800 without the need for a commissioning agent to readdress the new device.

In step 1005, if the first PCB 806 has been damaged, it is determined whether the first LED driver is faulty. If it is, a second plug-in module 805 containing a second PCB 806 comprising the same configuration information as the first PCB 806 is inserted into the second LED driver 800 in step 1006. Advantageously, the configuration information, such as DALI settings, may be transferred to the second LED driver 800 without the need for a commissioning agent to readdress the new device.

If the first LED driver circuit is not faulty, then in step 1007 a second plug-in module 805 is inserted into the first LED driver 800. According to an embodiment, as further discussed below, the LED driver 800 further comprises an internal memory. When the first plug-in module is inserted into the first LED driver, the configuration information from the first plug-in module is transferred and saved on the internal memory of the LED driver 800. Accordingly, the configuration information is backed up. When a second plug-in module 805 is inserted into the first LED driver 800 in step 1007, the configuration information stored on the memory of the LED driver may be transmitted and stored on the second plug-in module 805. Therefore, configuration information is not lost when either one of the memories fails.

FIG. 11 is a block diagram of an LED driver circuit 1100 of the LED driver 800 comprising a pluggable configuration module 805 (i.e., plug-in module) for driving an LED element 1120, according to an illustrative embodiment. The LED driver circuit 1100 may comprise various circuit components, including, but not limited to a bridge rectifier 1104, an optical isolator 1103, an active load 1106, a power factor corrector (PFC) 1108, high voltage bus 1110, an isolated high voltage power supply 1112, a low voltage supply 1114, and an LED drive MOSFET 1118. The functions of these components are discussed above with reference to FIG. 4. The functions the LED driver circuit 1100 may be dispersed through a plurality of circuit elements, or the functions of any two or more of these components may be integrated into a single circuit element.

The LED driver circuit 1100 may further comprise an intelligence circuit 1116 that may be connected through a plug-in interface 813 to the plug-in module 805, as discussed above. The plug-in module 805 may store custom configuration information, such as current level and network configuration information, to be used by the intelligence circuit 1116 to drive the LED element 1120.

According to an embodiment the LED driver circuit 1100 may receive an AC input 1101 or a DC input 1102 and output a constant-current to drive the LED element 1120. The LED driver circuit 1100 may receive an AC input 1101 comprising a dimmed hot AC voltage signal. The AC input 1101 may be supplied by an AC power source through a dimmer and may be a forward phase signal or a reverse phase signal. The dimmed hot AC voltage signal 1101 may be transformed into a low-voltage DC signal for powering the intelligence circuit 1116 and LED element 1120 via the bridge rectifier 1104, active load 1108, PFC 1108, high voltage bus 1110, isolated high voltage supply 1112, and low voltage supply 1114, as discussed above with reference to FIG. 4. According to an embodiment, the intelligence circuit 1116 receiving the low-voltage DC signal may detect the incoming dimming level and in response generate a constant electric current output to drive the LED element 1120 based on the detected dimming level and based on the configuration information provided by the plug-in module 805. The LED driver circuit 1100 may utilize PWM dimming technique by applying full current to the LED 1120 at a reduced duty cycle, as is known in the art. For example, for 50% brightness, full current output may be supplied at a 50% duty cycle.

According to another embodiment, the LED driver circuit 1100 may also receive a DC input 1102 from, for example, a 0-10V two-wire low voltage controller. The LED driver circuit 1100 may also receive a DALI digital communication signal at DC input 1102 from a 2 wire low voltage DALI controller. In another embodiment, the LED driver circuit 1100 may receive input from a S-wire phase controller providing a dimmed phase input, as well as a line and neutral voltage inputs. This DC input 1102 may be fed to the intelligence circuit 1116 through an optical isolator 1103, which transmits the DC input 1102 from the high-voltage side 1131 to the intelligence circuit 1116 on the low-voltage side 1132 of the LED driver circuit 1100, while keeping the low-voltage side 1131 and the high-voltage side 1132 isolated.

Referring to FIG. 12, there is shown a block diagram of the intelligence circuit 1116 and of the plug-in module 805 of the LED driver 800, according to an illustrative embodiment. The plug-in module 805 may comprise memory 810, external to the intelligence circuit 1116 (i.e., external memory). The plug-in module 805 may couple to the intelligence circuit 1116 via plug-in interface 813. As discussed above, the external memory 810 may comprise nonvolatile memory comprising any suitable nonvolatile storage medium, such as read-only memory (ROM), electrically erasable programmable read-only memory (EEPROM), Flash memory, ferroelectric RAM (F-RAM), a magnetic storage device such as a hard disc drive, or other types of memory. The external memory 810 of the plug-in module 805 may comprise configuration information used by the intelligence circuit 1116 to drive the LED element 1120.

The intelligence circuit 1116 may comprise various circuit components, including, but not limited to a microcontroller 1202, a dim level detector 1204, a PWM generator 1206, an internal memory 1210, and a plug-in detection circuit 1208. The plug-in detection circuit 1208 may be configured for detecting whether a plug-in module 805 is plugged in through the plug-in interface 813. The plug-in detection circuit 1208 may comprise a contact closure that senses the plug-in module 805 and sends a signal to the microcontroller 1202 that a plug-in module 805 is present.

The microcontroller 1202 may comprise at least one central processing unit (CPU) that can represent one or more microprocessors, "general purpose" microprocessors, special purpose microprocessors, application specific integrated circuits (ASICs), or any combinations thereof. The CPU can provide processing capabilities for one or more of the techniques and functions described herein. The microcontroller 1202 may comprise one or more modules for driving the LED element 1120. For example, the dim level detector 1204 and PWM generator 1206 may be modules of the microcontroller 1202. According to an embodiment the modules of the microcontroller 1202 may be implemented in software stored on a memory and executed by the microprocessor. However, according to another embodiment, the microcontroller 1202 or one or more of the modules of the microcontroller 1202 can be implemented in hardware.

The internal memory 1210 may comprise nonvolatile memory comprising any suitable nonvolatile storage medium, such as read-only memory (ROM), electrically erasable programmable read-only memory (EEPROM), Flash memory, ferroelectric RAM (F-RAM), a magnetic storage device such as a hard disc drive, or other types of memory. The microcontroller 1202 may be configured to detect the presence of a plug-in module 805 via the plug-in detection circuit 1208 and direct the external memory 810 to transmit its configuration information to the internal memory 1210 as appropriate. The internal memory 1210 may store the configuration information as backup. The configuration information copied to the internal memory 1210 may be used by the microcontroller 1202 for driving the LED element 1120. Similarly, configuration information stored on the internal memory 1210 may be transmitted to the external memory 810.

The dim level detector 1204 may be configured to detect the incoming dimming level, or the intended relative intensity, of the input signal transmitted to the intelligence circuit 1116 from either the AC input 1101 or DC input 1102. The incoming dimming level may be indicated in terms of a duty cycle, analog voltage, digital communications, or the like. For example, for a phase control signal received from AC input 1101, the dim level detector 1204 may be configured to detect the duty cycle of the input signal directly or may infer it from other variables of the waveform such as a switch-on time after zero cross, a voltage of switch-on time after zero cross, a switch-off time after zero-cross, a voltage of a switch-off time after zero cross, or any other waveform variable which may be used to detect duty cycle. The dim level detector 1204 may further detect or deduce the incoming dimming level from a digital communication signal received from a low voltage input (e.g., 0-10V), a DALI network, or from other types of control networks, for example, from a Zigbee network The microcontroller 1202 may receive the detected incoming dimming level from the dim level detector 1204, process it, and generate an output duty cycle based upon configuration information provided by the plug-in module 805, and stored on the internal memory 1210. The microcontroller 1202 may provide the output duty cycle to the PWM generator configured for generating a PWM signal from the output duty cycle. This PWM signal is fed from the PWM generator 1206 to the LED drive MOSFET 1118 (FIG. 11) that generates current to drive the LED element based on the PWM signal. The generated current will vary based on the dimming level generated by the microcontroller 1202 based on the sensed incoming duty cycle as well as based on the configuration information.

For a constant current type LED driver, the configuration information may indicate the output current level for the LED driver, which corresponds to the current level required by the LED element 1120 such that the LED driver can be precisely tailored to the LED element 1120. For example, the current level output configuration information may comprise 500 mA. According to an embodiment, the LED driver 800 may be configured to output from about 200 mA to about 1050 mA, in 1 mA, 5 mA, 10 mA, or other increments. The microcontroller 1202 uses the current level output setting to output a required current level to the LED element 1120. The PWM generator 1206 may comprise a feedback loop that determines the amount of current flowing to the LED element 1120 and provides that information to the microcontroller, which may utilize this information to adjust and maintain constant current. According to an embodiment, the LED driver 800 may comprise a plurality of outputs, each capable of independently driving LED elements at different current levels. For each such output, the configuration information can specify the required current level output to individually set the output current for each output.

The configuration information may also indicate the maximum dimming level (e.g., not to dim above 80%) and the minimum dimming level (e.g., not to dim below 10%). The maximum and minimum dimming levels can set to any values between about 0.1% to about 100%. Additionally, the configuration information may store predetermined values for the desired low-level duty cycle threshold $D_{Lth}$, the high-level duty cycle threshold $D_{Hth}$, the minimum duty cycle output $D_{min}$, the maximum duty cycle output $D_{max}$, the low end rescale value $S_L$, and the high end rescale value $S_H$, as discussed above.

The configuration information may also indicate the type of dimming curve utilized by a control device that provides a dimming signal to the LED driver 800. A dimming curve determines how dimmers set voltage output in response to control signal input. Using the dimming curve information, the microcontroller 1202 will know what type of dimming levels to expect at the input and whether and how to adjust these dimming levels to properly dim the LED element 1120. For example, the configuration information may indicate whether the dimming curve is a linear curve (where the control input percentage linearly matches to the Root Mean Square (RMS) voltage output), a logarithmic curve (where the voltage output is modified for better performance), including a modified linear curve, a square law curve, a modified square law curve, a sensor 2.0 curve, or the like.

The configuration information may also comprise a negative temperature coefficient (NTC) throttling temperature setting. The LED driver 800 may comprise an NTC module that monitors the temperature of the LED element. The NTC module may comprise a temperature sensor configured for directly connecting to a heat sink of the LED element 1120 to record temperature. The temperature sensor may comprise diodes, an on-chip sensor, a positive temperature coefficient (PTC) thermistor, a negative temperature coefficient (NTC) thermistor, or the like. When a critical temperature (or NTC throttling temperature) has been reached, the NTC module may trigger a response, such as scaling the output level, dimming the LED, reducing the current to the LED, turning off current to the LED, or the like, to reduce the temperature of the fixture and thereby increase the LED system's lifetime. The configuration information may comprise an NTC throttling temperature value. For example, the NTC throttling temperature value may be 181° F. or 185° F.

The configuration may further comprise network configuration information, such as DALI network configuration information. This information may include a network address (e.g., DALI address) of the LED driver 800, including a short and a long address. This information may further include commissioning settings, such as group assignments (indicating which lighting group the LED driver belongs to), lighting scene values or dimming levels, fading time (adjustment of dimming time or speed from one light level to next), hold time (period of time for holding one level), or the like.

Additionally, configuration information may contain tracked records. The internal memory 1210 may comprise an identification number, such as a serial number, of the LED driver 800. The external memory 810 of the plug-in module 805 may maintain a driver serial number history log configured for tracking the drivers the plug-in module 805 has been attached to. Thus, every time the plug-in module 805 gets plugged into a different LED driver, the plug-in module 805 may read the serial number of the LED driver from the driver's internal memory 1210, and record the serial number on its external memory 810. The driver serial number history log may be maintained in chronological order. In another embodiment, the plug-in module 805 may maintain a time clock and may time stamp each record. Similarly, the external memory 810 may comprise a serial number of the plug-in module 805. The internal memory 1210 of the LED driver 800 may maintain a plug-in module serial number history log configured for tracking the plug-in modules 805 that have been attached to the LED driver 800. Thus, every time the LED driver 800 receives a different plug-in module 805, the LED driver 800 may read the serial number of the plug-in module from external memory 810 and record the serial number on its internal memory 1210. This information may be timestamped. Thus, the system can track any changes and know whether the plug-in module 805 is used with a new driver 800, or whether the LED driver 800 is using a new plug-in module 805.

Additionally, the plug-in module 805 and the LED driver 800 may maintain their respective write count. This allows the LED driver 800 and plug-in module 805 to make a determination which configuration information, whether stored on internal memory 1210 or external memory 810, should be used to drive the LED element 1120. This write count may comprise a free counter that is incremented by one every time the configuration information has been written over from external memory 810 to internal memory 1210, and vice versa. The write count may also contain a time stamp indicating the time the configuration information has been written over.

The configuration information may comprise a record of running hours. The LED driver 800 may keep track of the number of hours the LED driver 800 has been turned on and save this information on external memory 810 and/or internal memory 1210. This information may be used for maintenance and warranty purposes. The configuration information may further comprise error history comprising a record of any relevant error that has occurred, such as a short circuit on the output, or the like. Therefore, if an LED driver 800 has failed, the plug-in module 805 may indicate a possible reason for the failure.

FIG. 13 illustrates a flowchart 1300 showing the process for configuring the LED driver according to an embodiment. The process starts in step 1301 when power is provided to the LED driver 800 causing the LED driver to start up. Then in step 1302, the LED driver 800, and more precisely the microcontroller 1202, first checks whether an external module (i.e., plug-in module 805) is present. LED driver 800 can determine whether an external module is present using the plug-in detection circuit 1208.

The following workflow illustrates scenario (A) where a first plug-in module 805 containing configuration information is plugged into a first LED driver 800 that may not contain configuration information, for example at the stage of production or instillation. In that scenario, the microcontroller 1202 of the first LED driver 800 checks and determines in step 1302 that the first plug-in module 805 is present. In step 1304, the microcontroller 1202 then reads the identification number, such as a serial number, of the first plug-in module 805 from external memory 810 and checks whether that serial number matches a serial number stored on internal memory 1210 by the first LED driver 800. According to an embodiment, the microcontroller 1202 may associate the serial number of a module most recently plugged into the LED driver 800 with the LED driver 800 and store that association on internal memory 1210. Therefore, step 1304 allows the microcontroller 1202 to check whether a new module was plugged in with new configuration information or whether an associated module was plugged in. In the preset scenario, the internal memory 1210 of the first LED driver 800 may not contain any serial numbers of any plug-in module as no plug-in module was ever plugged in. Therefore, the microcontroller 1202 determines that the serial number of the first module 805 does not match any associated serial number and proceeds to step 1305.

In step 1305, the microcontroller 1202 determines whether the first plug-in module 805 has a write count. Since the first plug-in module 805 contains configuration information, it would have at least one write count. As a result, the microcontroller 1202 determines that a new plug-in module is being plugged in with new configuration settings. Therefore in step 1306, the microcontroller 1202 writes the configuration information from the external memory 810 of the first module to the internal memory 1210 of the first LED driver. Additionally, in that step the microcontroller 1202 may associate the serial number of the first module 805 with the first LED driver 800 and store that association on internal memory 1210. The LED driver 800 may also record the read serial number of the first module in a plug-in module serial number history log on its internal memory 1210. Then in step 1308, the microcontroller 1202 increments its internal write count such that the module's write count equals to the LED driver's write count. Finally, in step 1310, the microcontroller 1202 uses the internal settings, including the newly written configuration information, from internal memory 1210 to drive the LED. Thereafter, if no module plug-in state change is sensed and reported by the plug-in detection circuit 1208 in step 1311, the microcontroller 1202 continues to use its internal settings in step 1310.

In another scenario, scenario (B), the first LED driver 800 may have failed during use. The first plug-in module 805 containing configuration information is unplugged from the first LED driver 800 and plugged into a second, new, LED driver. In that case, a module plug-in state changes in step 1311 and the process proceeds to step 1302. From there, scenario (B) will follow the same workflow as scenario (A). Particularly, in step 1306, the microcontroller 1202 of the second LED driver 800 will write configuration information from the external memory 810 of the first module to the internal memory 1210 of the second LED driver. Additionally, in that step the microcontroller 1202 may associate the serial number of the first module 805 with the second LED driver 800 and store that association on internal memory 1210. Effectively, the second LED driver 800 will impersonate the functionality of the failed first LED driver 800 by using the configuration information that was preserved in the first plug-in module 805.

In another scenario, scenario (C), the first plug-in module 805 may have failed during use, and a second, new, plug-in module 805 that may not contain configuration information is instead plugged into the first LED driver 800. In that case, a module plug-in state changes in step 1311 and the process proceeds to step 1302. In step 1302, the microcontroller 1202 of the first LED driver 800 checks and determines that the second plug-in module 805 is present. In step 1304, the microcontroller 1202 then reads the serial number of the second plug-in module 805 from external memory 810 and checks whether that serial number matches a serial number stored on internal memory 1210 of the first LED driver 800. In the preset scenario, the internal memory 1210 of the first LED driver 800 may store the serial number of the first module as being associated with the first LED driver 800. Therefore, in step 1304 the microcontroller 1202 determines that the serial number of the second module 805 does not match the associated serial number and proceeds to step 1305.

In step 1305, the microcontroller 1202 determines whether the second plug-in module 805 has a write count. Since the second plug-in module 805 does not contain any configuration information, it would not have a write count and the process proceeds to step 1312. In step 1312, the microcontroller 1202 of the first LED driver 800 writes the configuration information from its internal memory 1210 to the external memory 810 of the second module 805. Additionally, in that step the microcontroller 1202 may associate the serial number of the second module 805 with the first LED driver 800 and store that associated on its internal memory 1210. Then in step 1314, the microcontroller 1202 increments the external write count of the second module 805 to match that one of the first LED driver 800 and stores the write count on external memory 810 of the second module 805. Finally, in step 1310, the microcontroller 1202 proceeds to use its internal settings, including the configuration information, from internal memory 1210 to drive the LED element.

In yet another scenario, scenario (D), the first module 805 may have been removed or accidentally disconnected from the first LED driver 800 and no module has been plugged back in. In that case, a module plug-in state changes in step 1311 and the process proceeds to step 1302. In step 1302, the microcontroller 1202 of the first LED driver 800 checks and determines that no plug-in module 805 is present. In step 1310, the microcontroller 1202 uses the internal settings, including configuration information, stored on the internal memory 1210 to drive the LED element. This configuration information would have been written on internal memory 1210 of the first LED driver 800 from the dislodged first plug-in module 805.

In scenario (E), the first module 805 is thereafter plugged back into the first LED driver 800 without change to the configuration information. A module plug-in state changes in step 1311 and the process proceeds to step 1302. In step 1302, the microcontroller 1202 of the first LED driver 800 determines that the first plug-in module 805 is present. In step 1304, the microcontroller 1202 then reads the serial number of the first module 805 from external memory 810 and checks whether that serial number matches the associated serial number stored on internal memory 1210 of the first LED driver 800. Since the serial number of the first module 805 has been previously associated with first LED driver 800, the microcontroller 1202 then proceeds to step 1316. In step 1316, the microcontroller 1202 compares the module write count to the internal write count to determine whether the module write count is larger than internal write count. If it is not, then in step 1318 the microcontroller 1202 determines whether the module write count is equal to the internal write count. Since in scenario (E) the first module is just getting re-plugged into the first LED driver with no change in the configuration information on either the external memory or the internal memory, the write count would be equal. In step 1310, therefore, the microcontroller 1202 continues using the internal settings, including configuration information, stored on the internal memory 1210 to drive the LED element.

In scenario (F), the first module 805 may be removed and plugged into another device to receive updated configuration information. For example, the dimming settings may be changed, such as the dimming curve, maximum and minimum dimming levels, or the like. An installer may utilize a configuration tool into which the first module 805 can be plugged in and which can write new configuration information onto the first module 805. For example, such a configuration tool can comprise similar configuration to the GLDA-LED-PROG-CRESCODE, CREScode™ LED Driver Configuration Tool, available from Crestron Electronics, Inc. of Rockleigh, N.J. The CREScode™ LED Driver Configuration Tool is designed for use by lighting fixture manufacturers in the production of custom LED fixtures using Crestron Green Light® Dimmable LED Drivers (GLD-LED). The tool provides a simple means for programming an LED driver at the factory, allowing it to be matched perfectly to the fixture in which it is installed. The complete tool consists of a software application, hardware dongle and interface cables. The tool may comprise a plug-in interface 813 configured for connecting with the plug-in module 805.

Writing of the updated configuration information onto the first module 805 causes the first module 805 to have an incremented write count. The first module 805 may then get inserted back into the first LED driver 800 causing the module plug-in state to change in step 1311. In step 1302, the microcontroller 1202 of the first LED driver 800 determines that the first plug-in module 805 is present. In step 1304, the microcontroller 1202 checks whether the serial number of the first module 805 matches the associated serial number stored on internal memory 1210 on the first LED driver 800. Since the serial number of the first module 805 has been previously associated with the first LED driver 800, in step 1316, the microcontroller 1202 determines whether the module write count is larger than internal write count. Since the first module 805 contains updated configuration information and an incremented write count, the process proceeds to step 1306. As a result, the microcontroller 1202 determines that the first module 805 is being plugged in with new configuration settings, and in step 1306 writes the configuration information from the external memory 810 of the first module 805 to the internal memory 1210 of the first LED driver 800. Then in step 1308, the microcontroller 1202 increments its internal write count and in step 1310 uses its internal settings, including the newly written configuration information, from internal memory 1210 to drive the LED.

In another scenario, scenario (G), the first module 805 is removed from the first LED driver 800, the first LED driver 800 receives updated configuration information, and then the first module 805 is plugged back in. For example, while the first module 805 has been removed, the LED driver 800 may have received updated DALI settings from a control device and stored these settings on its internal memory 1210. This causes the LED driver 800 to have new configuration settings and an incremented write count. The first module 805 may then get inserted back into the first LED driver 800 causing the module plug-in state to change in step 1311. In step 1302, the microcontroller 1202 of the first LED driver 800 determines that the first plug-in module 805 is present. In step 1304, the microcontroller 1202 checks whether the serial number of the first module 805 matches the associated serial number stored on internal memory 1210 of the first LED driver 800. Since it does, in step 1316, the microcontroller 1202 determines whether the module write count is larger than internal write count. Since the LED driver 800 contains updated configuration information and an incremented write count, the process proceeds to step 1318. In step 1318, the microcontroller 1202 determines whether the module write count is equal to the internal write count, and since it is not, it proceeds to step 1320. As a result, the microcontroller 1202 determines that the first module 805 is being plugged in with old configuration settings, and therefore in step 1320, the microcontroller 1202 writes the configuration information from the internal memory 1210 of the first LED driver 800 to the external memory 810 of the first module 805. Then in step 1321, the microcontroller 1202 increments the external write count of the second module 805 and stores it on external memory 810. Finally, in step 1310, the microcontroller 1202 proceeds to use its internal settings, including the configuration information, from internal memory 1210 to drive the LED element.

INDUSTRIAL APPLICABILITY

The disclosed embodiments provide a system, software, and a method for an LED driver which uses the dimmed signal to determine output power to the LED. Additionally, an LED driver may comprise a removable PCB comprising configuration information, such as current levels and DALI information. It should be understood that this description is not intended to limit the embodiments. On the contrary, the embodiments are intended to cover alternatives, modifications, and equivalents, which are included in the spirit and scope of the embodiments as defined by the appended claims. Further, in the detailed description of the embodiments, numerous specific details are set forth to provide a comprehensive understanding of the claimed embodiments. However, one skilled in the art would understand that various embodiments may be practiced without such specific details.

Although the features and elements of aspects of the embodiments are described being in particular combinations, each feature or element can be used alone, without the other features and elements of the embodiments, or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

The above-described embodiments are intended to be illustrative in all respects, rather than restrictive, of the embodiments. Thus the embodiments are capable of many variations in detailed implementation that can be derived from the description contained herein by a person skilled in the art. No element, act, or instruction used in the description of the present application should be construed as critical or essential to the embodiments unless explicitly described as such. Also, as used herein, the article "a" is intended to include one or more items.

Additionally, the various methods described above are not meant to limit the aspects of the embodiments, or to suggest that the aspects of the embodiments should be implemented following the described methods. The purpose of the described methods is to facilitate the understanding of one or more aspects of the embodiments and to provide the reader with one or many possible implementations of the processed discussed herein. The steps performed during the described methods are not intended to completely describe the entire process but only to illustrate some of the aspects discussed above. It should be understood by one of ordinary skill in the art that the steps may be performed in a different order and that some steps may be eliminated or substituted.

All United States patents and applications, foreign patents, and publications discussed above are hereby incorporated herein by reference in their entireties.

Alternate Embodiments

Alternate embodiments may be devised without departing from the spirit or the scope of the invention. For example, the PCB may be external to the housing of the LED driver.

What is claimed is:

1. A light emitting diode (LED) driver configured for receiving an input signal and generating an output signal to power at least one LED element, the LED driver comprising:

a driver housing;

an opening in the driver housing configured for receiving a removable plug-in module, wherein the plug-in module comprises an external memory storing configuration information and an identification number of the plug-in module, wherein the configuration information comprises current output level;

a plug-in interface configured for providing electrical connection between the plug-in module and the LED driver; and at least one driver circuit disposed within the driver housing and comprising an internal memory, a microcontroller, and a plug-in detection circuit, wherein the microcontroller comprises a processor configured for executing one or more processor-executable instructions stored in the internal memory that cause acts to be performed comprising:

receiving a signal that the plug-in module is plugged into the plug-in interface from the plug-in detection circuit;

reading the identification number of the plug-in module;

associating the identification number of the plug-in module with the LED driver and storing the association on the internal memory;

receiving the configuration information from the external memory of the plug-in module; and regulating the output signal provided to the at least one LED element such that the driver circuit generates an output signal substantially equal to the output current level.

2. A light emitting diode (LED) driver configured for receiving an input signal and generating an output signal to power at least one LED element, the LED driver comprising:

a driver housing;

an opening in the driver housing configured for receiving a removable plug-in module, wherein the plug-in module comprises an external memory storing configuration information;

a plug-in interface configured for providing electrical connection between the plug-in module and the LED driver; and at least one driver circuit disposed within the driver housing and comprising an internal memory and a microcontroller, wherein the microcontroller comprises a processor configured for executing one or more processor-executable instructions that cause acts to be performed comprising:

receiving the configuration information from the external memory of the plug-in module; and regulating the output signal provided to the at least one LED element based on the configuration information.

3. The LED driver of claim 2, wherein the plug-in module comprises a housing portion and a printed circuit board (PCB) containing the external memory.

4. The LED driver of claim 3, wherein the opening comprises a first recessed portion sized and shaped for receiving the housing portion of the plug-in module; and wherein the opening further comprises a second recessed portion sized and shaped for receiving the PCB.

5. The LED driver of claim 3, wherein driver housing is configured for receiving the plug-in module such that the PCB is internal to the driver housing and an upper surface of the housing portion of the plug-in module is substantially flush with an outer surface of the driver housing.

6. The LED driver of claim 2, wherein the plug-in interface comprises at least one of a serial port, a Universal Serial Bus (USB) interface, a mini-USB interface, a micro-USB interface, a CREScode interface, and a RJ45 interface.

7. The LED driver of claim 2, wherein the microcontroller is further configured for:

writing the configuration information from the external memory of the plug-in module to the internal memory; and regulating the output signal provided to the at least one LED element based on the configuration information stored on the internal memory.

8. The LED driver of claim 2, wherein the configuration information comprises an output current level, wherein the microcontroller regulates the output signal such that the driver circuit generates an output signal substantially equal to the output current level.

9. The LED driver of claim 2, wherein the LED driver comprises a plurality of outputs, and wherein the configuration information comprises output current levels for each output of the plurality of outputs.

10. The LED driver of claim 2, wherein the input signal comprises a dimming level, wherein the microcontroller is further configured for:

detecting an incoming dimming level of the input signal; and generating an output duty cycle ($D_{out}$) based upon the detected incoming dimming level and the configuration information;

wherein the driver circuit is configured for generating a current to drive the at least one LED element based on the output duty cycle ($D_{out}$).

11. The LED driver of claim 10, wherein the configuration information comprises one or more dimming level parameters.

12. The LED driver of claim 11, wherein the one or more dimming level parameters comprise at least one of a maximum dimming level, a minimum dimming level, or a combination thereof.

13. The LED driver of claim 11, wherein the one or more dimming level parameters comprise parameters configured for keeping the LED element at a low power until the detected incoming duty cycle ($D_{in}$) exceeds a low-end dimming level.

14. The LED driver of claim 11, wherein the one or more dimming level parameters comprise parameters configured for setting the output duty cycle ($D_{out}$) equal to a minimum duty cycle output value ($D_{min}$) when the detected incoming duty cycle ($D_{in}$) falls below a low-level duty cycle threshold ($D_{Lth}$).

15. The LED driver of claim 11, wherein the one or more dimming level parameters comprise parameters configured for keeping the LED element at a high power when the detected incoming dimming level exceeds a high-end dimming level.

16. The LED driver of claim 11, wherein the one or more dimming level parameters comprise parameters configured for setting the output duty cycle ($D_{out}$) equal to a maximum duty cycle output value ($D_{max}$) when the detected incoming duty cycle ($D_{in}$) exceeds a high-level duty cycle threshold ($D_{Hth}$).

17. The LED driver of claim 11, wherein the one or more dimming level parameters comprise parameters configured for scaling the detected incoming duty cycle ($D_{in}$) to a value between a low end rescale value ($S_L$) and a high end rescale value ($S_H$) when the detected incoming duty cycle ($D_{in}$) falls between a low-level duty cycle threshold ($D_{Lth}$) and a high-level duty cycle threshold ($D_{Hth}$).

18. The LED driver of claim 10, wherein the configuration information indicates a type of a dimming curve, including at least one of a linear curve a logarithmic curve, a modified linear curve, a square law curve, a modified square law curve, and a sensor 2.0 curve.

19. The LED driver of claim 2, wherein the configuration information comprises a negative temperature coefficient (NTC) throttling temperature value.

20. The LED driver of claim 2, wherein the configuration information comprises network configuration information for the LED driver.

21. The LED driver of claim 20, wherein the network configuration information comprises at least one of a network address, a group assignment, a lighting scene value, a dimming level, a fading time, a hold time, and any combinations thereof.

22. The LED driver of claim 2, wherein the external memory of the plug-in module comprises an identification number of the plug-in module.

23. The LED driver of claim 22, wherein the microcontroller is further configured for:

reading the identification number of the plug-in module; and determining whether the identification number matches an identification number stored on the internal memory.

24. The LED driver of claim 23, wherein the microcontroller is further configured for:

when the identification number of the plug-in module does not match the identification number stored on the internal memory or when no identification number is stored on the internal memory, determining whether the external memory of the plug-in module comprises configuration information;

when the external memory comprises configuration information, writing configuration information from the external memory of the plug-in module to the internal memory; and when the external memory does not comprise configuration information, writing configuration information from the internal memory to the external memory.

25. The LED driver of claim 24, wherein the microcontroller determines whether the plug-in module comprises configuration information by determining whether the plug-in module comprises a write count.

26. The LED driver of claim 23, wherein the microcontroller is further configured for:

when the identification number of the plug-in module matches the identification number stored on the internal memory, comparing a write count of the external memory to the write count of the internal memory;

when the write count of the external memory is larger than the write count of the internal memory, writing configuration information from the external memory of the plug-in module to the internal memory; and when the write count of the internal memory is larger than the write count of the external memory, writing configuration information from the internal memory to the external memory.

27. The LED driver of claim 22, wherein the microcontroller is further configured for:

reading the identification number of the plug-in module; and storing the identification number of the plug-in module on the internal memory in a plug-in module identification number history log.

28. The LED driver of claim 22, wherein the microcontroller is further configured for:

associating the identification number of the plug-in module with the LED driver and storing the association on the internal memory.

29. The LED driver of claim 28, wherein the LED driver receives a second removable plug-in module comprising a second external memory storing a second configuration information and a second identification number, wherein the microcontroller is further configured for:

determining whether the second identification number matches the identification number stored on the internal memory;

writing the second configuration information from the second external memory of the second plug-in module to the internal memory; and regulating the output signal provided to the at least one LED element based on the second configuration information.

30. The LED driver of claim 2, wherein the microcontroller is further configured for:

determining whether a new plug-in module has been received by the LED driver by determining whether an identification number of a newly inserted plug-in module matches an identification number stored on the internal memory.

31. The LED driver of claim 2, wherein the at least one driver circuit comprises a plug-in detection circuit configured for detecting whether a plug-in module is plugged into the plug-in interface.

32. The LED driver of claim 2, wherein the internal memory of the LED driver comprises an identification number of the LED driver.

33. The LED driver of claim 32, wherein the microcontroller is further configured for:

storing the identification number of the LED driver on the external memory in an LED driver identification number history log.

34. A method for operating a light emitting diode (LED) driver comprising a driver housing, an opening in the driver housing, a plug-in interface in the opening, at least one driver circuit disposed within the driver housing and comprising an internal memory and a microcontroller, wherein the method comprising the steps of:

receiving a plug-in module through the opening and in the plug-in interface, wherein the plug-in module comprises an external memory storing configuration information;

receiving the configuration information from the external memory of the plug-in module;

receiving an input signal from a power source; and generating an output signal to power at least one LED element based on the configuration information.

35. The method of claim 34, wherein the input signal comprises a dimming level, wherein the method further comprises the steps of:

detecting an incoming duty cycle of the input signal; and generating an output duty cycle based upon the detected incoming duty cycle and the configuration information;

wherein the output signal is generated based on the output duty cycle.

36. The method of claim 34 further comprising the steps of:

writing the configuration information from the external memory of the plug-in module to the internal memory of the at least one driver circuit.

37. The method of claim 34, wherein the external memory of the plug-in module comprises an identification number of the plug-in module, wherein the method further comprises the steps of:

reading the identification number of the plug-in module; and determining whether the identification number of the plug-in module matches an identification number stored on the internal memory.

38. The method of claim 37 further comprising the steps of:

when the identification number of the plug-in module does not match the identification number stored on the internal memory or when no identification number is stored on the internal memory, determining whether the external memory of the plug-in module has a write count;

when the external memory comprises a write count, writing configuration information from the external memory of the plug-in module to the internal memory; and when the external memory does not comprise a write count, writing configuration information from the internal memory to the external memory.

39. The method of claim 37 further comprising the steps of:

when the identification number of the plug-in module matches the identification number stored on the internal memory, comparing a write count of the external memory to the write count of the internal memory;

when the write count of the external memory is larger than the write count of the internal memory, writing configuration information from the external memory of the plug-in module to the internal memory; and when the write count of the internal memory is larger than the write count of the external memory, writing configuration information from the internal memory to the external memory.

40. The method of claim 34, wherein the external memory of the plug-in module comprises an identification number of the plug-in module, wherein the method further comprises the steps of:

reading the identification number of the plug-in module; and associating the identification number of the plug-in module with the LED driver and storing the association on the internal memory of the LED driver.

* * * * *